United States Patent [19]

Sato et al.

[11] Patent Number: 4,696,887

[45] Date of Patent: Sep. 29, 1987

[54] METHOD FOR FORMATION OF AN IMAGE COMPRISING A HEATING STEP

[75] Inventors: Kozo Sato; Hiroshi Kitaguchi; Masashi Takeuchi; Masaaki Tsukase; Masatoshi Kato, all of Kanagawa, Japan

[73] Assignee: Fuji Photo Film Co., Ltd., Kanagawa, Japan

[21] Appl. No.: 829,032

[22] Filed: Feb. 13, 1986

[30] Foreign Application Priority Data

Feb. 13, 1985 [JP] Japan ..... 60-26039

[51] Int. Cl.[4] ..... G03C 5/54; G03C 1/06; G03C 5/26; G03C 1/34

[52] U.S. Cl. ..... 430/203; 430/223; 430/353; 430/611; 430/617; 430/619; 430/957; 430/960; 430/351; 430/352

[58] Field of Search ..... 430/203, 223, 353, 352, 430/611, 617, 619, 957, 960, 351

[56] References Cited

U.S. PATENT DOCUMENTS 4,431,728 2/1984 Abe et al. ..... 430/544
4,499,181 2/1985 Watanabe et al. ..... 430/558
4,500,626 2/1985 Naito et al. ..... 430/203

FOREIGN PATENT DOCUMENTS 1053633 3/1986 Japan ..... 430/203

*Primary Examiner*—Richard L. Schilling
*Assistant Examiner*—Lee C. Wright
*Attorney, Agent, or Firm*—Sughrue, Mion, Zinn, Macpeak & Seas

[57] ABSTRACT

A novel method for formation of an image comprising a heating step, comprising the heating carried out in the presence of a compound of general formula (I):

$$X—SO_2(DI) \quad (I)$$

wherein X represents a reducing group capable of reducing a silver salt and capable of being oxidized by heating and in its oxidized state capable of releasing a compound represented by (DI)—$SO_2NH_2$ by reaction with a nucleophilic agent; and (DI) represents a development inhibiting group capable of inhibiting the oxidation reduction reaction of the silver salt and a reducing aent.

The compound of the formula (I) functions to inhibit development after a certain period of time from the beginning of heat development.

The present method provides a stable image with reduced fog and image mottle.

13 Claims, No Drawings

METHOD FOR FORMATION OF AN IMAGE COMPRISING A HEATING STEP

FIELD OF THE INVENTION

The present invention relates to a method for formation of an image comprising a heating step and, more precisely, to a method for formation of an image by heat development in which a reducing compound capable of releasing a development inhibitor is used in a heating step.

BACKGROUND OF THE INVENTION

Photography using silver halide has been most widely used since the photographic characteristics of silver halide systems such as sensitivity, gradation control, etc., are superior to those of other photographic processes such as electrophotography or a diazo process. Recently, an improved photographic technique has been developed capable of simply and rapidly forming an image, where the image formation of a silver halide light-sensitive material is carried out by means of a dry process under heat instead of a conventional wet process using a developing agent or the like. Heat developable light-sensitive materials are known in this technical field, and various heat developable light-sensitive materials and processes are described, for example, in *Shashin Kogaku no Kiso,* pp. 553–555 (Corona Publishing, 1979); *Eizo Joho* (April, 1978), p. 40; *Neblett's Handbook of Photography and Reprography,* pp. 32–33, 7th Ed. (Van Nostrand Reinhold Company); U.S. Pat. No. 3,152,904, 3,301,678, 3,392,020, 3,457,075, British Pat. No. 1,131,108, 1,167,777, and *Research Disclosure* (RD-17029), pp. 9–15 (June, 1978).

Many processes for formation of color images are known. In a method for formation of color images by the reaction of an oxidized developing agent and a coupler, U.S. Pat. No. 3,531,286 has proposed a combination of a p-phenylenediamine reducing agent and a phenolic or active methylene coupler; U.S. Pat. No. 3,761,270 describes a p-aminophenol reducing agent; Belgian Pat. No. 802,519 and *Research Disclosure,* pp. 31–32 (September, 1975) describe a sulfonamidophenol reducing agent; and U.S. Pat. No. 4,021,240 has proposed a combination of a sulfonamidophenol reducing agent and a tetra-equivalent coupler.

For formation of positive color images by a light-sensitive silver dye bleaching process, *Research Disclosure* (RD-14433), pp. 30–32 (April, 1976) and (RD-15227), pp. 14–15 (December, 1976) and U.S. Pat. No. 4,235,957 disclose useful dyes and a bleaching process.

In addition, European Pat. Nos. 76,492 and 79,056 and Japanese Patent Application (OPI) Nos. 28928/83 and 26008/83 disclose a method for formation of color images by heat development using a compound initially having a dye moiety and capable of releasing a diffusible dye corresponding to or reversely corresponding to a reduction reaction in which a silver halide is reduced to silver at a high temperature (the term "OPI" as used herein refers to a "published unexamined Japanese patent application").

Such heat developable light-sensitive materials are developed under heat in a substantially water-free state. Since the heat development of the photographic material is a dry treatment, simple and rapid formation of an image is possible, which is an advantage of these heat developable light-sensitive materials.

Despite this significant advantage, heat developable materials have some troublesome problems. For example, since it is not possible to supply any photographically useful reagents from a developer or other solution, all of the necessary reagents have to be incorporated in the light-sensitive material. Accordingly, when a certain photographically useful reagent is to be formed at the beginning of development, or is to be formed, released or diffused with a desired timing, selection of only the desired reaction or cooperation of two or more reactions is technically most important. In particular, a technique for formation, release and diffusion of a development restrainer with a certain timing after development begins, for the purpose of inhibition of fogging due to hyper development, development termination after a certain period of time and inhibition of image density mottle due to uneven heating, is extremely important, and will determine the image quality of the heat developable light-sensitive materials.

Certain timing techniques for releasing a photographically useful reagent during the photographic treatment of a photographic material have heretofore been known in conventional and instant photography systems, including the use of a polymer shielded layer which becomes permeable with a desired timing or the use of a reagent having an active part that is previously blocked with a protective group which may be de-protected during development. However, these conventional means cannot be utilized in a heat development system, or if used, provide an insufficient effect in this system. Under the circumstances, a novel and effective timing technique which is efficiently applicable to the heat development system is required.

SUMMARY OF THE INVENTION

Accordingly, one object of the present invention is to provide a novel timing technique for efficiently releasing a photographically useful reagent in a method for formation of an image including a heating step, and in particular, to provide a compound capable of providing development inhibition after a certain period of time from the beginning of heat development.

Another object of the present invention is to provide a novel method for formation of an image including a heating step, capable of providing a stable image with reduced fog and image mottle.

These and other objects of the present invention have now been attained by a method for formation of an image comprising a heating step, comprising the heating carried out in the presence of a compound of the general formula (I):

$$X—SO_2(DI) \qquad (I)$$

wherein X represents a reducing group capable of reducing a silver salt and capable of being oxidized by heating and in its oxidized state capable of releasing a compound represented by (DI)—$SO_2NH_2$ by reaction with a nucleophilic agent; and (DI) represents a development inhibiting group capable of inhibiting the oxidation reduction reaction of the silver salt and a reducing agent.

DETAILED DESCRIPTION OF THE INVENTION

Typical examples of the reducing group represented by X are given below, but the present invention should not be construed as being limited thereto. (The definition of each residue has the same meaning as given in the corresponding patent specification.)

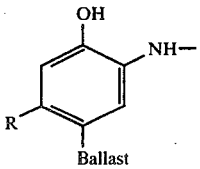

U.S. Pat. No. 4,055,428

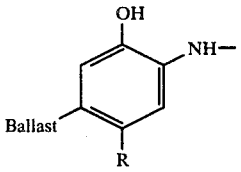

U.S. Pat. No. 4,336,322

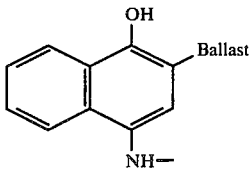

U.S. Pat. No. 3,928,312

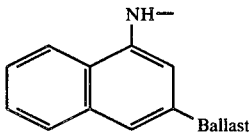

U.S. Pat. No. 4,053,312

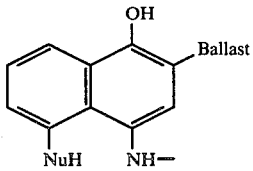

Japanese Patent Application (OPI) No. 65839/84

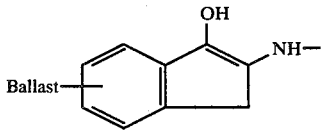

Japanese Patent Application (OPI) No. 3819/78

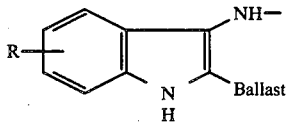

Japanese Patent Application (OPI) No. 104343/76

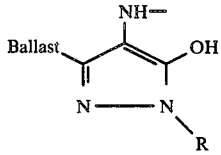

Japanese Patent Application (OPI) No. 104343/76

-continued

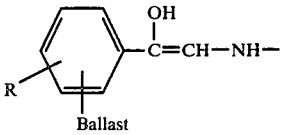

Japanese Patent Application (OPI) No. 104343/76

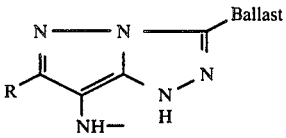

Research Disclosure, No. 17465

These reducing groups contain a ballast group which may make the compound of the formula (I) substantially nondiffusible. The ballast group may be any substituent having a sufficiently large molecular weight to immobilize the compound and most generally is a hydrophobic group having 8 or more carbon atoms (such as an alkyl group, an aralkyl group or an alkoxy group).

The most typical development inhibiting group compounds represented by (DI) in the formula (I) are those of the following general formula (II). These are most effective.

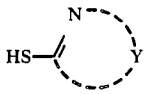

(II)

In the formula (II), Y represents an atomic group necessary for formation of a 5-membered or 6-membered heterocyclic ring (preferably containing at least one sulfur atom, nitrogen atom or oxygen atom in the ring), and a block group is bonded with a sulfur or nitrogen atom.

Preferred examples of the development inhibiting group of the formula (II) are the following compounds, although the present invention is not to be construed as being limited thereto:

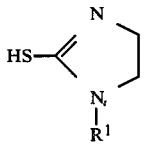

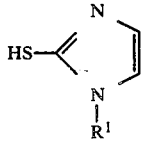

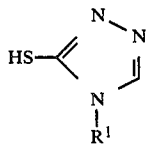

-continued
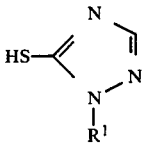
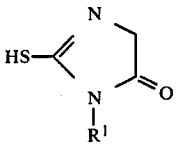
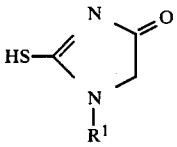
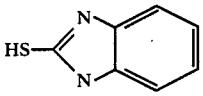
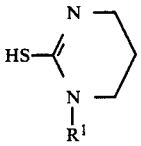
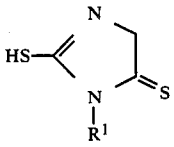
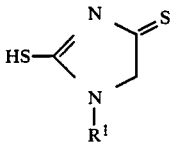
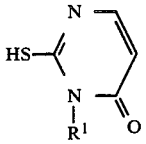
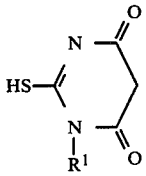
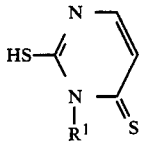
-continued
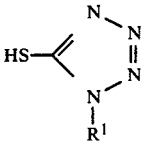
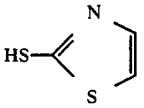
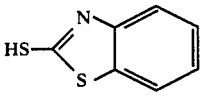
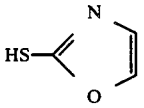
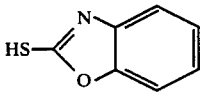
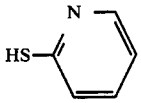
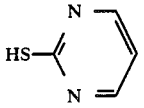
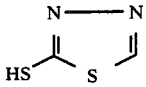
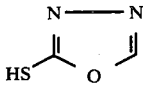
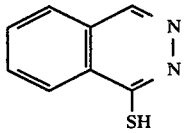
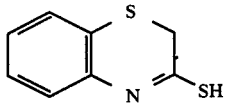
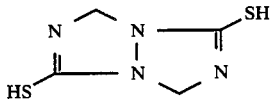
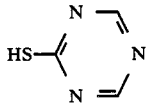

-continued

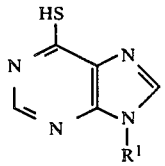

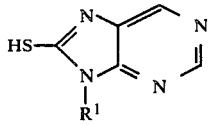

In these examples, $R^1$ represents a group selected from a hydrogen atom, an alkyl group, an aryl group, a cycloalkyl group, an alkenyl group and an aralkyl group.

Among these compounds, those in which the active SH group or NH group (in the case of tautomers) is blocked with a protective group capable of being deprotected during heat development are extremely effective and have an extremely remarkable timing effect. Various protective groups may be used, including a blocking group of an acyl group or a sulfonyl group as described in Japanese Patent Publication No. 44805/72; a blocking group capable of releasing a photographically useful reagent by a reverse Michael reaction as described in Japanese Patent Publication Nos. 17369/79, 9696/80 and 34927/80; a blocking group capable of releasing a photographically useful reagent together with formation of quinonemethide or quinonemethide analog compounds by an intramolecular electron transfer reaction as described in Japanese Patent Publication No. 39727/79, and Japanese Patent Application (OPI) Nos. 135944/82, 135945/82 and 136640/82; a blocking group formed by intramolecular ring closure reaction as described in Japanese Patent Application (OPI) No. 53330/80; or a blocking group formed by ring cleavage of a 5-membered or 6-membered ring as described in Japanese Patent Application (OPI) Nos. 76541/82, 135949/82 and 179842/82.

Apart from these compounds, other compounds may also be used in the present invention as a development inhibiting group represented by (DI), which may form a heterocyclic compound having a development restrainability by ring closure reaction under heat during heat development. Examples of these compounds are given below.

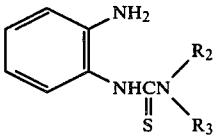

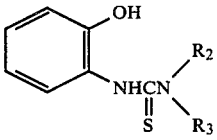

-continued

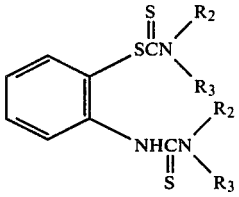

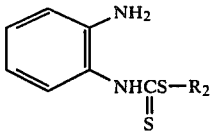

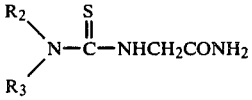

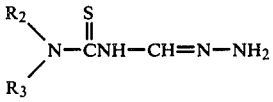

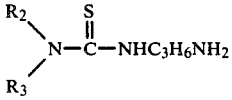

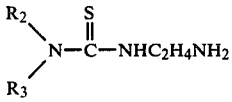

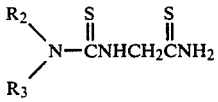

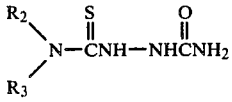

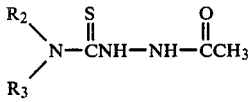

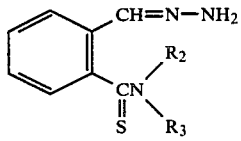

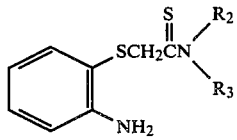

In the above formulae, $R_2$ and $R_3$ each represents a substituent selected from a hydrogen atom, an alkyl group, an aralkyl group, a cycloalkyl group, an aryl group and a heterocyclic group.

The above described development inhibiting group may be bonded with a reducing group at any position thereof by the $SO_2$ group.

Examples of the nucleophilic agent which may be used in the present invention include water and water releasing compounds (such as ammonium alum and iron alum), amines (such as octylamine, dodecylamine, octadecylamine, dicyclohexylamine, aniline, p-toluidine, p-anisidine and 2,4-xylidine), amidines (such as acetamidine, benzamidine, N-methylacetamidine, imidazoline and tetrahydropyrimidine), guanidines (such as guanidine, methylguanidine, N,N-dimethylguanidine, 2-aminoimidazoline, 2-aminotetrahydropyrimidine and 2-aminobenzimidazole), hydroxylamines (such as hydroxylamine, N-methylhydroxylamine and o-methylhydroxylamine), hydrazines (such as methylhydrazine, N,N-dimethylhydrazine and phenylhydrazine), hydrazides (such as acetohydrazide, benzhydrazide, hydrazide isonicotinate and p-toluenesulfonylhydrazine), oximes (such as acetoxime, benzaldoxime and salicylaldoxime), hydroxamic acids (such as acetohydroxamic acid, benzhydroxamic acid and p-toluenesulfohydroxamic acid), sulfonamides (such as benzenesulfonamide, p-chlorobenzenesulfonamide and dodecylbenzenesulfonamide), sulfamides (such as sulfamide, N,N-dimethylsulfamide and N,N-dipropylsulfamide), active methylene compounds (such as malononitrile, acetoacetic acid anilide and 1-phenyl-3-methyl-5-pyrazolone), alcohols (such as dodecanol, glycerol, pentaerythritol and p-xylylene glycol) and thiols (such as hexadecanethiol and dodecylbenzenethiol). Furthermore, salts and precursors of these compounds may be used.

In the present invention compounds described in Japanese Patent Application (OPI) Nos. 194202/82 and 680521/84 are particularly useful as the nucleophilic agent.

It is desirable that the nucleophilic agent and the compound represented by the general formula (I) are present in the same layer.

The compounds of the formula (I) of the present invention react directly or indirectly with a silver salt by an oxidation reduction reaction in the presence of a catalyst of a latent image nucleus during heat development, whereby the reducing group moiety of the compound is converted to an oxidant thereof. Thus, the oxidant is thereafter cleaved due to the action of a nucleophilic reagent existing in a light-sensitive material to release a compound of (DI)—$SO_2NH_2$.

On the other hand, when a "direct positive emulsion" is used, the oxidation reduction reaction occurs in a non-exposed area of the material.

The released (DI)—$SO_2NH_2$ lacking a non-diffusible ballast group is thermally diffusible in a dry film, and therefore, diffuses to the surface of silver halide or other silver salt grains and reacts with a silver ion to form a stable silver salt therein to prevent further development. Although not desiring to be bound by theory, it is considered that plural steps comprising oxidation reduction, cleavage reaction of oxidized compound and diffusion in sequence are required until the compound of (DI)—$SO_2NH_2$ may diffuse into the surface of silver salt grains, and therefore, a timing control capacity capable of appropriately controlling the timing of the development inhibiting effect provided by the compound may be attained. When the development inhibiting group is a precursor of a development inhibitor, a further step for conversion of the precursor to a development restrainer is added, and thus, a larger timing control capacity may be attained.

In addition, the compound of the formula (I) of the present invention may exist in the form of a solution in fine oil droplets in a light-sensitive material. In this case, some additional time is required for the released compound of (DI)—$SO_2NH_2$ to diffuse out from the oil droplets, and this additional time may effectively be utilized for timing control.

By the process according to the present invention, a novel technique has been discovered by the present inventors capable of providing a development inhibiting effect after a certain period of time from the beginning of the development. The timing of the development inhibiting effect may appropriately be regulated by the selection of a suitable reducing group and development inhibiting group, as well as of the position and the state of the reducing group and development inhibiting group in the light-sensitive material to be developed. Selection of an appropriate timing interval for the development inhibition results in the formation of a stable image, since superdevelopment and occurrence of fog may be prevented without lowering the density of the formed image.

Preferred examples of compounds of the formula (I) of the present invention are given below, which, however, are not to be construed as limiting the scope of the present invention.

(1)

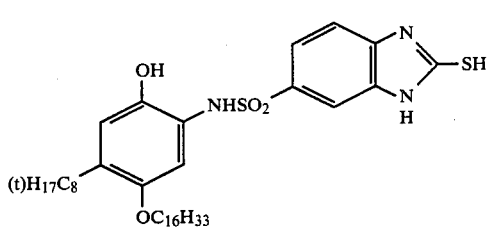

(2)

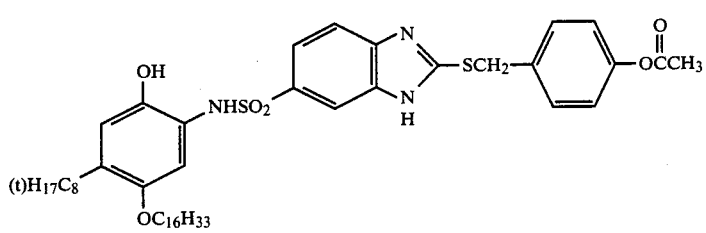

-continued
(3)
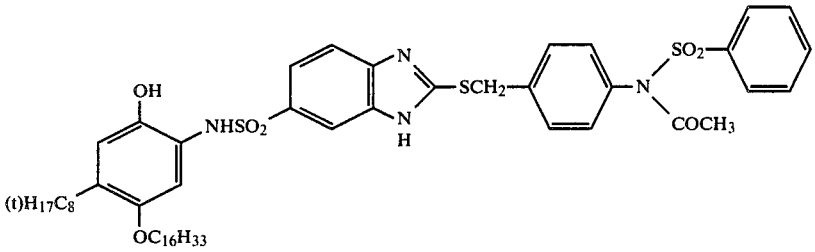
(4)
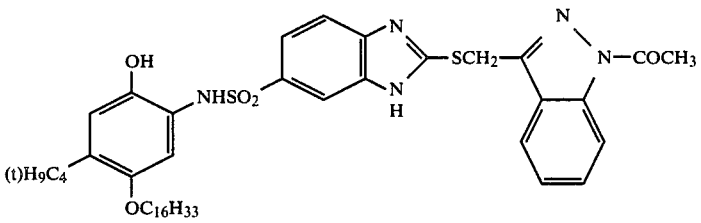
(5)
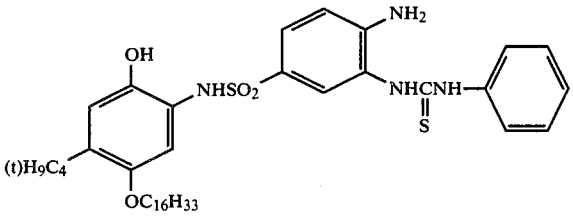
(6)
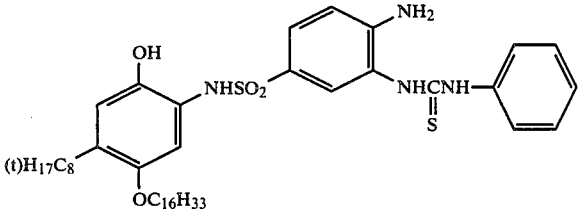
(7)
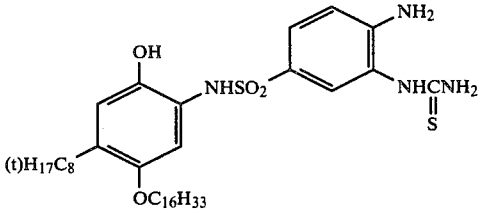
(8)
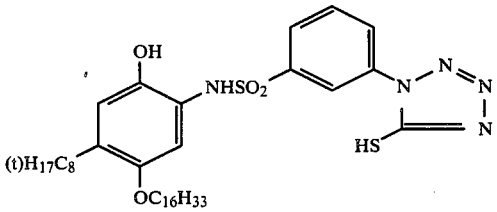
(9)
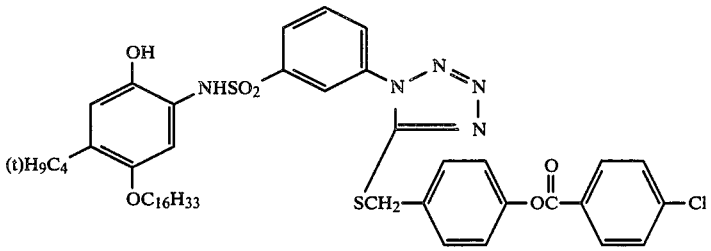

-continued
(10)
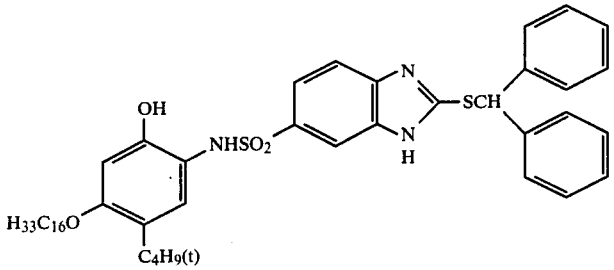
(11)
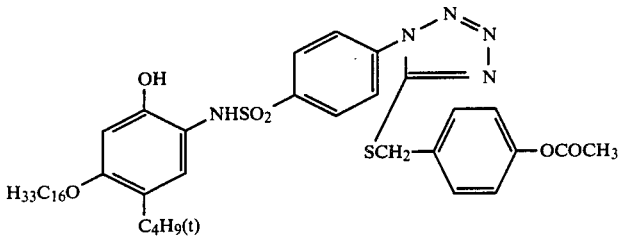
(12)
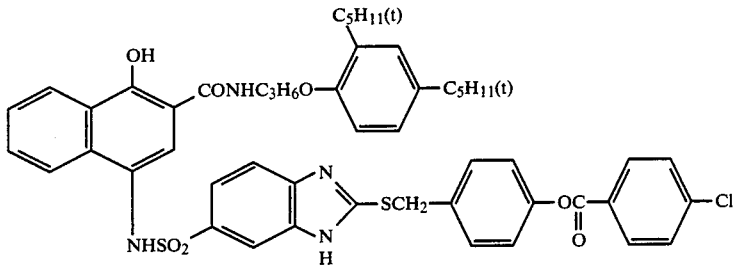
(13)
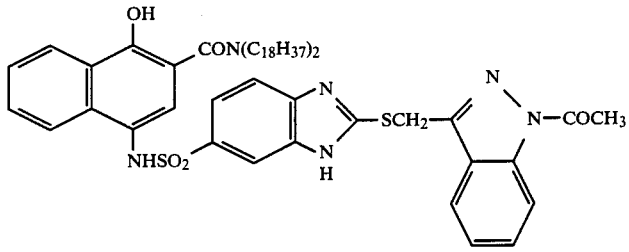
(14)
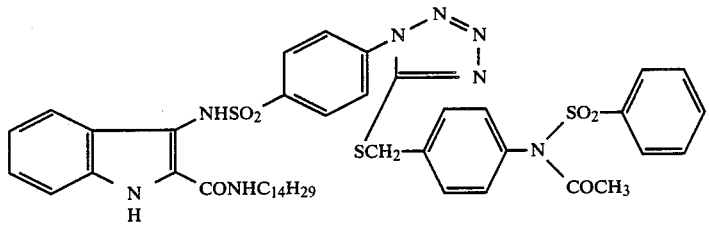
(15)
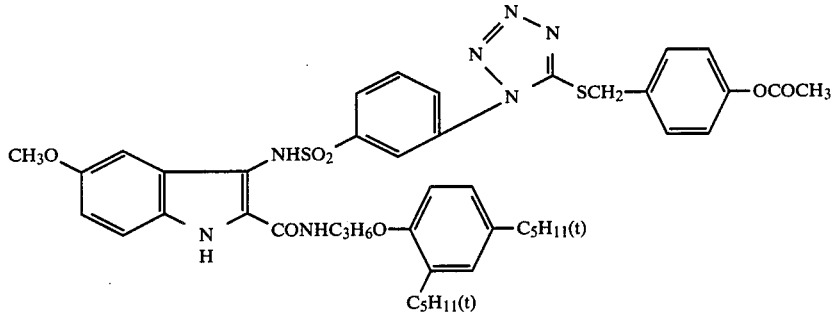

-continued
(16)
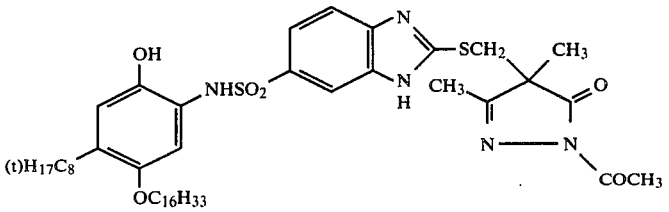
(17)
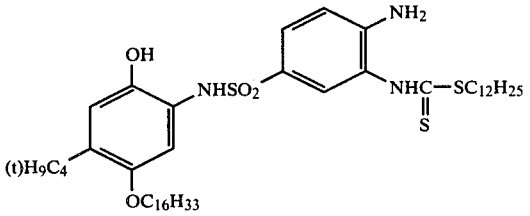
(18)
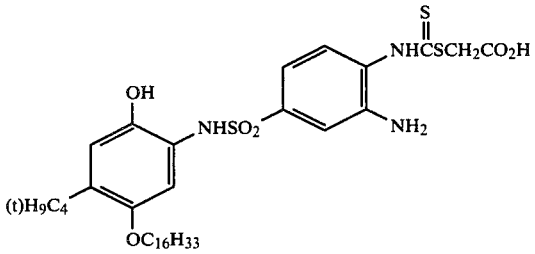
(19)
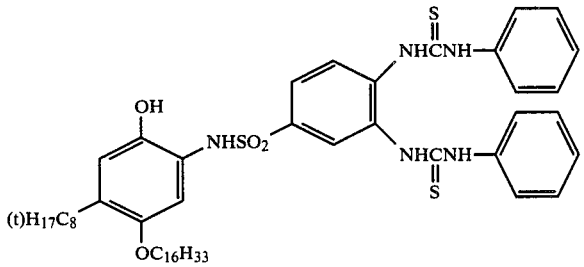
(20)
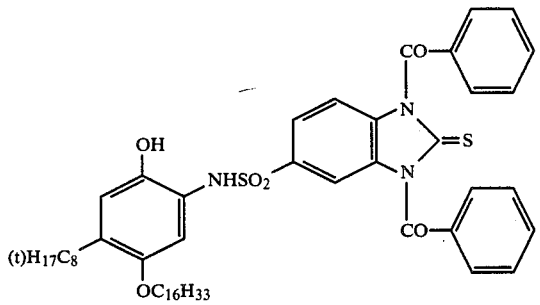
(21)
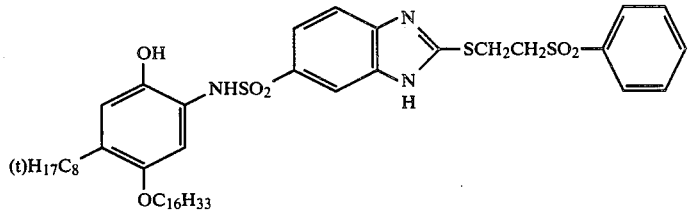

-continued (22)

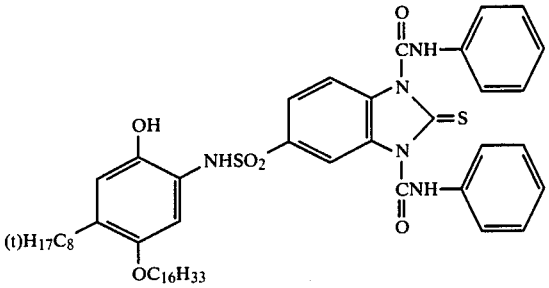

(23)

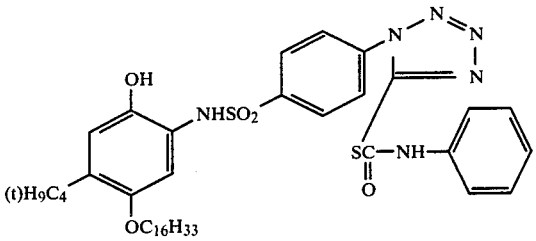

(24)

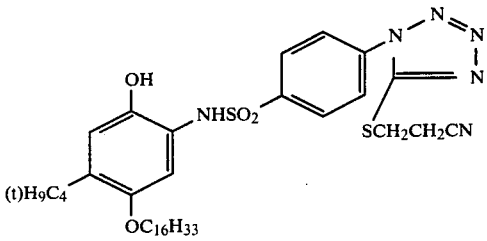

(25)

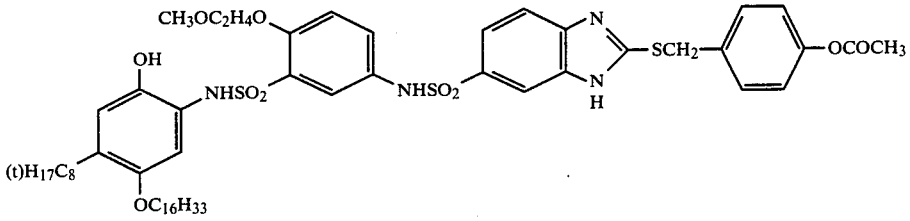

(26)

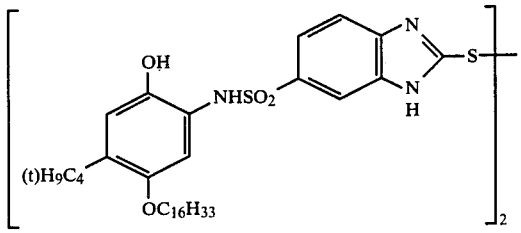

A method for synthesis of the compounds of the formula (I) of the present invention will be explained hereunder.

The compounds of the formula (I) may be obtained by a method in which the terminal amino group of the reducing group "X" and the terminal sulfonic acid halide group of the development inhibiting group "(DI)" are condensed in the presence of a base, or alternatively by another method in which a sulfonamide derivative ($X—SO_2—Y$) containing the reducing group "X" is first formed and then the substituent "Y" in the derivative is converted into "(DI)" by functional group conversion. In either case the method is freely selected in accordance with the constitution of "(DI)". The synthesis of the compounds of the formula (I) is explained in detail by reference to specific examples given hereunder, although these examples are illustrative and any other suitable synthesis method may be used.

Synthesis of Compound No. (1)

Reaction Scheme

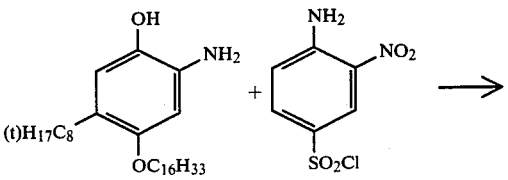

(1-a)

-continued

Reaction Scheme

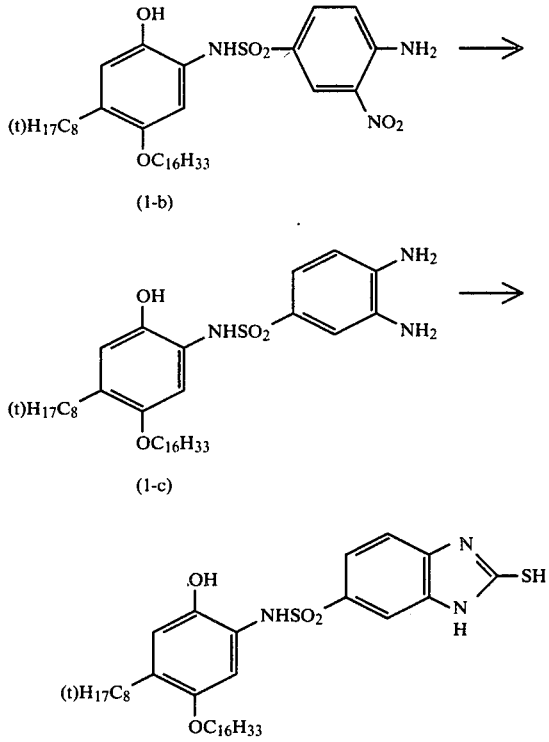

126.8 g (0.2 mol) of p-toluenesulfonate of the formula (1-a) was dissolved in a mixture comprising 100 ml of pyridine and 400 ml of dimethylacetamide, and then 56.8 g (0.24 mol) of 4-amino-3-nitrobenzenesulfonyl chloride was added thereto little by little at 5° to 8° C. The reaction mixture was stirred for 1 hour at 5° to 10° C., and then was poured into a mixture comprising 200 ml of hydrochloric acid, 500 ml of water and 300 g of ice, little by little. The crystal precipitated was recovered by filtration and washed with water and thereafter recrystallized, while wet, from methanol to finally obtain 125 g of a yellow-green crystal of a compound of the formula (1-b).

A mixture comprising 35 g of active iron, 2 g of ammonium chloride, 300 ml of isopropanol and 30 ml of water was heated at 70° C., and then 44 g of Compound (1-b) was gradually added thereto at 70° to 80° C. Next, 10 ml of acetic acid was added thereto, and the whole was heated under reflux for 2 hours. The reaction solution was filtered, while hot, with a Celite bed, and 150 ml of water was gradually added to the resulting filtrate solution, to separate a pale brown oil which then gradually crystallized. After being stirred for 1 hour at 5° C., the crystal formed was recovered by filtration and washed with a dilute isopropanol, to obtain 40.5 g of a compound of the formula (1-c). A mixture of 20 g of Compound (1-c), 12 g of thiourea and 50 ml of diglyme was heated and stirred for 2 hours at 140° C. in a nitrogen atmosphere. After being cooled, the reaction solution was poured into a dilute hydrochloric acid, and the gray precipitate formed was recovered by filtration. The resulting crude product was purified by means of silica gel chromatography (eluent: ethyl acetate/hexane=1/1), to obtain 9.6 g of a compound of the above formula (1), having an m.p. of 215°–216° C.

Synthesis of Compound No. (4)

A mixture comprising 6.73 g of Compound No. (1), 2.78 g of 1-acetyl-3-bromomethylindazole, 1.52 g of potassium carbonate and 30 ml of acetone was heated under reflux for 3 hours. After being cooled, the reaction solution was poured into a dilute hydrochloric acid and then extracted with ethyl acetate. The separated organic layer was rinsed with water and dried, and then ethyl acetate was distilled out under reduced pressure. The residue obtained was purified by means of silica gel chromatography, to obtain 5.1 g of a white crystal of Compound No. (4) having an m.p. of 128°–135° C.

Synthesis of Compound No. (6)

2.4 g of phenylisothiocyanate was added little by little to a mixture comprising 10 g of Compound (1-c), 30 ml of acetonitrile and 20 ml of ethyl acetate at room temperature. The reaction mixture was heated for 1 hour at 40° to 50° C. and then 0.6 g of phenylisothiocyanate was further added and the reaction mixture was then heated for 1 hour at 60° C. After being cooled, the solvent was distilled out under reduced pressure and the residue obtained was purified by means of silica gel chromatography, to obtain 5.8 g of Compound No. (6) having an m.p. of 211°–212° C.

The image forming method according to the present invention includes an indispensable step of a heating step that may be carried out in any stage of the image formation procedure, for example, in the step of heat development or in the step of heat transferring. Heating also may be carried out in the step of imagewise heat exposure.

Examples of heat developable light-sensitive materials which may be used in the image forming method of the present invention where heating is carried out for the purpose of development are those containing a silver halide or a diazo compound. The compound of the formula (I) of the present invention may be incorporated in the light-sensitive material, or otherwise, may be added to a material for fixation of an imagewise distributed diffusible dye (a dye fixing material). In addition, the present Compound (I) may be applied to a light-sensitive material or to the dye-fixing material during heating.

Silver halides used in the present invention may be any of silver chloride, silver bromide, silver iodide and silver chlorobromide, silver chloroiodide, silver iodobromide and silver chloroiodobromide. These silver halide grains may either have a uniform halogen composition or have a multilayer structure comprising different inner and outer halogen compositions, e.g., as disclosed in Japanese Patent Application (OPI) Nos. 154232/82, 108533/83, 48755/84 and 52237/84, U.S. Pat. No. 4,433,048 and European Pat. No. 100,984. Regarding the shape of the silver halide grains, tubular grains having a thickness of about 0.5 μm or less, a diameter of at least about 0.6 μm and an average aspect ratio of about 5 or more (as described, e.g., in U.S. Pat. Nos. 4,414,310 and 4,435,499 and West German Patent Application (OLS) No. 3,241,646A1) may be used in the present invention. In addition, a monodisperse system emulsion containing silver halide grains of nearly uniform grain size distribution as described, e.g., in Japanese Patent Application (OPI) Nos. 178235/82, 100846/83 and 14829/83, International Patent (OPI)

No. 83/02338A1, and European Pat. Nos. 64,412A3 and 83,377A1 may also be used in the present invention. Furthermore, two or more silver halides each having a different crystal habit, halogen composition, grain size and grain size distribution may be used together, and it is also possible to blend two or more monodisperse system emulsions each having a different grain size thereby to suitably regulate the gradation of an image to be formed.

The range of the grain size of silver halide grains to be used in the present invention preferably falls within an average grain size of about 0.001 μm to 10 μm, more preferably about 0.001 μm to 5 μm. The silver halide emulsion may be prepared by any conventional manner such as an acid method, a neutral method or an ammonia method. For the reaction of a soluble silver salt and a soluble halogen salt, any of a single jet method or a double jet method or a combination thereof may be used. In addition, a reverse mixing method where silver halide grains are formed in the presence of an excess of silver ion; or a controlled double jet method where the pAg is kept constant may also be used. In order to accelerate the growth of silver halide grains in the reaction, the concentration of the silver salt and halogen salt to be added, as well as the amount thereof and the rate of addition thereof may be elevated appropriately, as described in Japanese Patent Application (OPI) Nos. 142329/80 and 158124/80 and U.S. Pat. No. 3,650,757.

Silver halide grains of epitaxial overgrown type may also be used in the present invention, as described in Japanese Patent Application (OPI) No. 16124/81 and U.S. Pat. No. 4,094,684.

When a silver halide is used in the present invention without also using any organic silver salt oxidizing agent, it is preferred to use silver chloroiodide, silver iodobromide and silver chloroiodobromide in which an X-ray pattern of silver iodide crystals may be detected.

These silver salts may be formed, for example, as follows: A silver nitrate solution is first added to a potassium bromide solution to form silver bromide grains, and then potassium iodide is added thereto, to obtain silver iodobromide having the desired characteristics.

In the step of forming silver halide grains to be used in the present invention, a solvent for dissolving a silver halide may be used, such as ammonia or an organic thioether derivative as described in Japanese Patent Publication No. 11386/72 or a sulfur-containing compound as described in Japanese Patent Application (OPI) No. 144319/78.

During the step of formation of silver halide grains or physical ripening thereof, a cadmium salt, a zinc salt, a lead salt or a thallium salt may be present.

In addition, in order to improve any high intensity reciprocity failure or low intensity reciprocity failure, a water-soluble iridium salt such as iridium (III, IV) chloride or ammonium hexachloroiridate, or a water-soluble rhodium salt such as rhodium chloride may further be used.

Soluble salts, if any, may be removed from the silver halide emulsion, after the formation of silver halide precipitates or after the physical ripening thereof, which may be carried out by noodle washing or by a sedimentation method.

The silver halide emulsion may be used without being post-ripened, but in general, the emulsion is used after being chemically sensitized. An emulsion for a light-sensitive material of a general type may be ripened by a conventional sulfur sensitization method, a reduction sensitization method or noble metal sensitization method or a combination thereof. These chemical sensitization methods may be carried out in the presence of a nitrogen-containing heterocyclic ring compound (as described in Japanese Patent Application (OPI) Nos. 126526/83 and 215644/83).

The silver halide emulsion used in the present invention may be a surface latent image type where a latent image is formed mainly on the surface of silver halide grains, or an internal latent image type where a latent image is formed mainly in the inner part of the grains. In addition, a direct reversal emulsion comprising a combination of an internal latent image type emulsion and a nucleating agent may also be used in the present invention. Various kinds of internal latent image type emulsions which are suitable for this purpose are described in U.S. Pat. Nos. 2,592,250 and 3,761,276, Japanese Patent Publication No. 3534/83 and Japanese Patent Application (OPI) No. 136641/82. Preferred nucleating agents which may be used in the present invention in combination with the internal latent image type emulsion are described in U.S. Pat. Nos. 3,227,552, 4,245,037, 4,255,511, 4,266,031 and 4,276,364 and West German Patent Application (OLS) No. 2,635,316.

The amount of the light-sensitive silver halide coated in the light-sensitive material of the present invention falls within the range of about 1 mg/m$^2$ to 10 g/m$^2$ calculated as silver.

In the present invention, an organic metal salt which is relatively stable to light may be used as an oxidizing agent, together with a light-sensitive silver halide. An organic silver salt is especially preferably used among such organic metal salts. When the organic metal salt is used in the light-sensitive material for heat development according to the present invention, when the light-sensitive material is heated at a temperature of about 80° C. or higher, preferably about 100° C. or higher, the organic metal salt oxidizing agent is considered to participate in the redox reaction occurring under heat in the presence of a silver halide latent image as a catalyst.

Examples of organic compounds which may be used as the organic components of organic silver salt oxidizing agents include aliphatic or aromatic carboxylic acids, thiocarbonyl group-containing compounds having a mercapto group or α-hydrogen, and imino group-containing compounds.

Typical examples of silver salts of aliphatic carboxylic acids include those of behenic acid, stearic acid, oleic acid, lauric acid, capric acid, myristic acid, palmitic acid, maleic acid, fumaric acid, tartaric acid, furoinic acid, linoleic acid, linolenic acid, adipic acid, sebacic acid, succinic acid, acetic acid, butyric acid or camphoric acid. In addition, silver salts of halogen-substituted or hydroxyl-substituted derivatives of these fatty acids or those of thioether group-containing aliphatic carboxylic acids may also be used in the present invention.

Examples of silver salts of aromatic carboxylic acids or other carboxyl-containing compounds include those of benzoic acid, 3,5-dihydroxybenzoic acid, o-, m- or p-methylbenzoic acid, 2,4-dichlorobenzoic acid, acetamidobenzoic acid, p-phenylbenzoic acid, gallic acid, tannic acid, phthalic acid, terephthalic acid, salicylic acid, phenylacetic acid, pyromellitic acid or 3-carboxymethyl-4-methyl-4-thiazoline-2-thione. Examples of silver salts of mercapto- or thiocarbonyl-containing compounds include those of 3-mercapto-4-phenyl-1,2,4-triazole, 2-mercaptobenzimidazole, 2-mercapto-5-aminothiadiazole, 2-mercaptobenzothiazole, s-alkylthioglycolic acid (in which the alkyl has 12 to 22 carbon atoms), dithiocarboxylic acids such as dithioacetic acid, thioamides such as thiostearoamide, 5-carboxy-1-methyl-2-phenyl-4-thiopyridine, mercaptotriazine, 2-mercaptobenzoxazole, mercaptoxadiazole or 3-amino-5-benzylthio-1,2,4-triazole, and the like mercapto compounds, as described in U.S. Pat. No. 4,123,274.

Examples of silver salts of imino-containing compounds include those of benzotriazole or derivatives thereof as described in Japanese Patent Publication Nos. 30270/69 and 18416/70, for example, benzotriazole, methylbenzotriazole and the like alkyl-substituted benzotriazoles, 5-chlorobenzotriazole and the like halogen-substituted benzotriazoles, and butylcarboimidobenzotriazole and the like carboimidobenzotriazoles; those of nitrobenzotriazoles as described in Japanese Patent Application (OPI) No. 118639/83; those of sulfobenzotriazole, carboxybenzotriazole or salts thereof, and hydroxybenzotriazole as described in Japanese Patent Application (OPI) No. 118638/83; and those of 1,2,4-triazole, 1H-tetrazole, carbazole, saccharin, imidazole and derivatives thereof as described in U.S. Pat. No. 4,220,709.

In addition, silver salts as described in *Research Disclosure,* RD 17029 (June, 1978) and other organic metal salts than silver salts such as copper stearate, and silver salts of carboxylic acid compounds containing an alkynyl group such as phenylpropiolic acid as described in Japanese Patent Application No. 221535/83 may also be used in the present invention.

The amount of organic silver salt incorporated in the light-sensitive material of the present invention is about 0.01 to 10 mols, preferably about 0.01 to 1 mol, on the basis of 1 mol of the light-sensitive silver halide. The total amount of the light-sensitive silver halide and organic silver salt is suitably about 50 mg to 10 g/m$^2$.

The silver halide used in the present invention may be spectrally sensitized with a methine dye or similar sensitizing dye. Sensitizing dyes which may be used for spectral sensitization include cyanine dyes, merocyanine dyes, complex cyanine dyes, complex merocyanine dyes, holopolar cyanine dyes, hemicyanine dyes, styryl dyes and hemioxonol dyes. Especially preferred dyes are cyanine dyes, merocyanine dyes and complex merocyanine dyes. These dyes may contain any and every conventional basic heterocyclic nucleus, which is generally contained in coventional cyanine dyes, including a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, and a pyridine nucleus; alicyclic hydrocarbon ring-fused nuclei of such nuclei; and aromatic hydrocarbon ring-fused nuclei of such nuclei, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, and a quinoline nucleus. These nuclei may optionally have substituent(s) on their carbon atom(s). Merocyanine dyes and complex merocyanine dyes may contain a ketomethylene structural nucleus, such as a 5- or 6-membered heterocyclic nucleus, including a pyrazolin-5-one nucleus, a thiohydantoin nucleus, a 2-thiooxazolidine-2,4-dione nucleus, a thiazolidine-2,4-dione nucleus, a rhodanine nucleus, and a thiobarbituric acid nucleus.

These sensitizing dyes may be used singly, or may be used in a combination of two or more sensitizing dyes. The combination use of sensitizing dyes is often utilized for the purpose of supersensitization.

The photographic emulsion of the present invention may further contain, together with a sensitizing dye, a dye which itself does not have any spectral sensitization activity or a substance which does not substantially absorb any visible light but has a supersensitization activity. For example, the present emulsion may contain an aminostyryl compound substituted by a nitrogen-containing heterocyclic group, e.g., as described in U.S. Pat. Nos. 2,933,390 and 3,635,721; an aromatic organic acid/formaldehyde condensation product, e.g., as described in U.S. Pat. No. 3,743,510; a cadmium salt or an azaindene compound. In particular, the combinations described in U.S. Pat. Nos. 3,615,613, 3,615,641, 3,617,295 and 3,635,721 are especially preferred.

In order to incorporate a sensitizing dye into the silver halide photographic emulsion, the dye may directly be dispersed in the emulsion, or alternatively, the dye may first be dissolved in a solvent such as water, methanol, ethanol, acetone or methyl cellosolve or a mixture thereof, the resulting solution being added to the emulsion. In addition, the sensitizing dye can first be dissolved in a solvent which is immiscible with water such as phenoxyethanol, the resulting solution being dispersed in water or in a hydrophilic colloid, after which the resulting dispersion is added to the emulsion. Another method for incorporation of a sensitizing dye into the present photographic emulsion is by admixing the sensitizing dye with an oleophilic compound such as a dye providing compound, and incorporating the sensitizing dye in the emulsion together with the dye providing compound. When the sensitizing dye is dissolved, another sensitizing dye which is to be used in combination may be dissolved separately in a separate solvent, or alternatively, a mixture of sensitizing dyes to be used together may be dissolved in a single solvent. When the sensitizing dye is added to an emulsion, two or more sensitizing dyes may be added simultaneously in the form of a mixture thereof, or each sensitizing dye may be added separately, or the sensitizing dye may be added together with any other additives. Regarding the time when the sensitizing dye is to be added to the emulsion, the dye may be added thereto during chemical ripening or before or after chemical ripening, or the dye may be added to the emulsion before or after the formation of silver halide grain nuclei, according to the method of U.S. Pat. Nos. 4,183,756 or 4,225,666.

The amount of sensitizing dye to be added to the emulsion is, in general, about $10^{-8}$ to $10^{-2}$ mol per mol of the silver halide.

In the method of the present invention, a dye providing substance, i.e., a compound capable of forming or releasing a diffusible dye in correspondence or counter-correspondence to the reduction reaction of silver halide to silver under conditions of high temperature, is preferably incorporated in the light-sensitive material.

These dye providing substances are described in greater detail as follows.

One dye providing substance which may be used in the present invention is a combination of a developing agent and a coupler capable of reacting with the agent. In this system where a coupler is used, an oxidized developing agent is formed by the oxidation reduction reaction of the developing agent and an exposed silver salt, and the oxidized developing agent then reacts with a coupler to form a dye. Examples of typical developing agents and couplers are described in detail in T. H. James, *The Theory of the Photographic Process,* pp. 291–334 and pp. 354–361 (4th Ed., 1977); and Shinichi Kikuchi, *Photographic Chemistry,* pp. 284–295 (4th Ed., Kyoritsu Publishing).

Another dye providing substance useful in the present invention is a silver-dye compound comprising a combination of an organic silver salt and a dye. Examples of silver-dye compounds are described in *Research Disclosure* (May, 1978) (RD-16966), pp. 54–58.

Still another dye providing substance is an azo dye which is used in a silver-dye bleaching method for heat development. Examples of such azo dyes and the bleaching process are described in U.S. Pat. No. 4,235,957 and *Research Disclosure* (April, 1976) (RD-14433), pp. 30–32.

Still another dye providing substance is a leuco dye as described in U.S. Pat. Nos. 3,985,565 and 4,022,617.

The most preferred dye providing substance which may effectively be used in the method of the present invention is a compound capable of imagewise releasing and diffusing a diffusible dye, for example, described in European Pat. No. 76492.

These compounds may be represented by the general formula (III):

$$(\text{Dye}—X')_n—Y' \qquad \text{(III)}$$

wherein Dye represents a dye residue or a dye precursor residue; X' represents a single bond or a linking group; Y' represents a group capable of yielding a difference of diffusibility of a compound of formula $(\text{Dye}—X')_n—Y'$, corresponding to or reversely corresponding to a light-sensitive silver salt in imagewise latent image distribution, or alternatively Y' represents a group capable of releasing Dye and yielding a difference of diffusibility between the released Dye and the compound of formula $(\text{Dye}—X')_n—Y'$; n is an integer of 1 or 2; and when n is 2, the two (Dye—X') moieties may be the same or different.

Various dye providing substances of the formula (III) are known, as disclosed in, e.g., U.S. Pat. Nos. 3,134,764, 3,362,819, 3,597,200, 3,544,545 and 3,482,972, describing color developers comprising a combination of a hydroquinone type developing agent and a dye component; Japanese Patent Application (OPI) No. 63618/76 describing compounds that may release a diffusible dye by an intra-molecular nucleophilic substitution reaction; and Japanese Patent Application (OPI) No. 111628/75 describing compounds that may release a diffusible dye by the intra-molecular rearrangement reaction of an isoxazolone ring. In each of these methods a diffusible dye is released or diffused in a non-developed image area, but the dye is neither released nor diffused in a developed area.

In addition, in these methods both development and release or diffusion of a dye occur simultaneously and, therefore, it is extremely difficult to obtain an image of high S/N ratio. In order to overcome this disadvantage, another method has been proposed, in which a dye releasing compound is first converted into an oxidized form having no dye releasing ability and the oxidized compound is used together with a reducing agent or a precursor thereof. After development, the oxidized compound is reduced with the reducing agent, which has remained unoxidized, thereby to release a diffusible dye from the reduced compound. Examples of such dye providing substances are described, for example, in Japanese Patent Application (OPI) Nos. 110827/78, 130927/79, 164342/81 and 35533/78.

Other substances are known capable of releasing a diffusible dye in a developed image area. For instance, British Pat. No. 1,330,524, Japanese Patent Publication No. 39165/73 and U.S. Pat. No. 3,443,940 describe substances capable of releasing a diffusible dye by the reaction of a coupler having a removable diffusible dye group and a developing agent in an oxidized form; and U.S. Pat. No. 3,227,550 describes substances capable of forming a diffusible dye by the reaction of a coupler having a removable nondiffusible group and a developing agent in an oxidized form.

However, methods using such color developing agents have a severe disadvantage that the image formed is often stained due to the presence of an oxidized and decomposed product of the developing agent used. In order to overcome this problem, therefore, dye releasing compounds which themselves have a reductivity and do not require any developing agent have been proposed. Typical examples of such compounds are described in U.S. Pat. Nos. 3,928,312, 3,725,062, 3,728,113, 3,443,939, 4,053,312, 4,055,428, 4,336,322, Japanese Patent Application (OPI) Nos. 65839/84, 69839/84, 3819/78, 104343/76, 116537/83, and *Research Disclosure,* No. 17465.

All of the above described dye providing substances may be used as desired in the method of the present invention.

Examples of image forming substances which may be used in the method of the present invention are described in the above mentioned patents and publications. Preferred compounds among them are illustrated by the following specific examples, which are not to be construed as limiting the scope of the present invention since it is impossible to describe all such image forming substances in the present specification. for instance, the dye providing substances represented by general formula (III) include the following compounds:

(III-1)

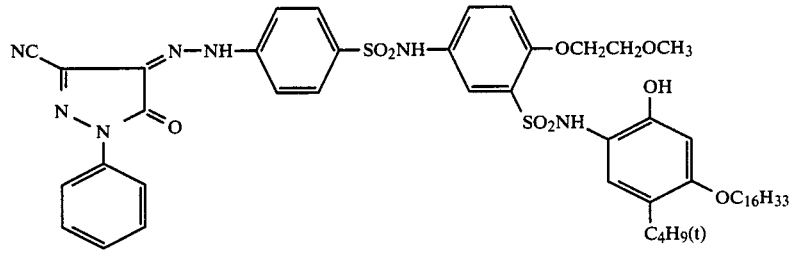

-continued
(III-2)
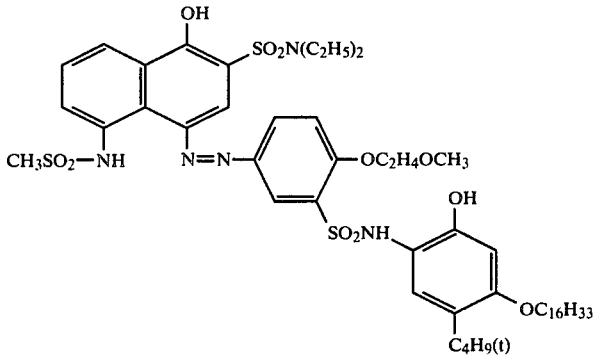
(III-3)
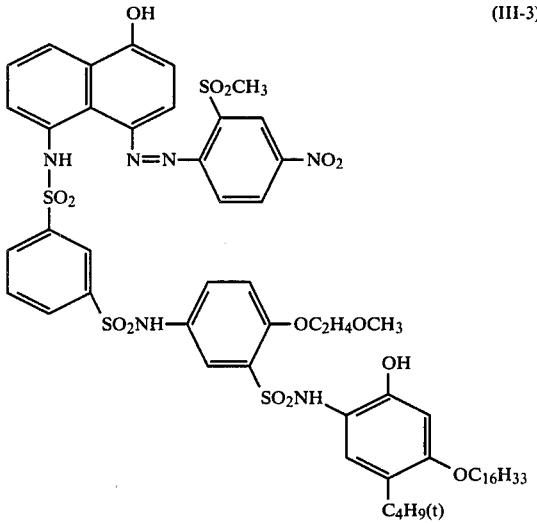
(III-4)
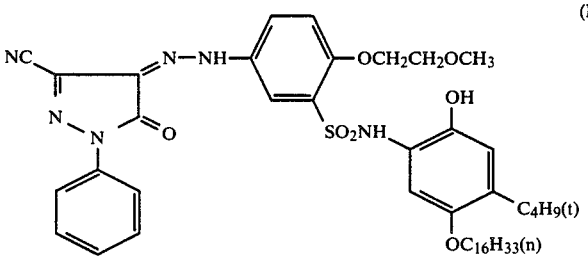
(III-5)
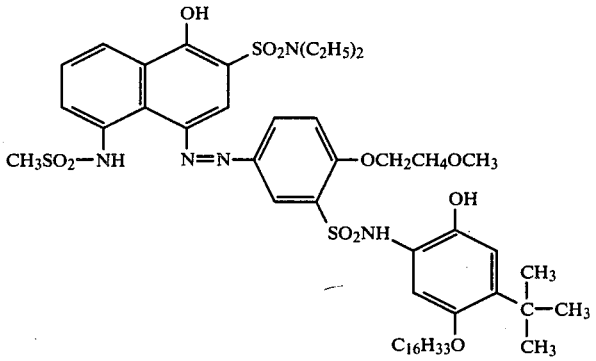
(III-6)
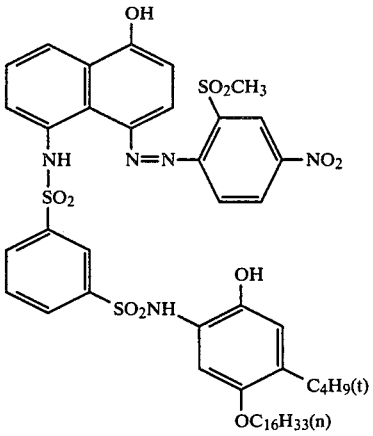
(III-7)
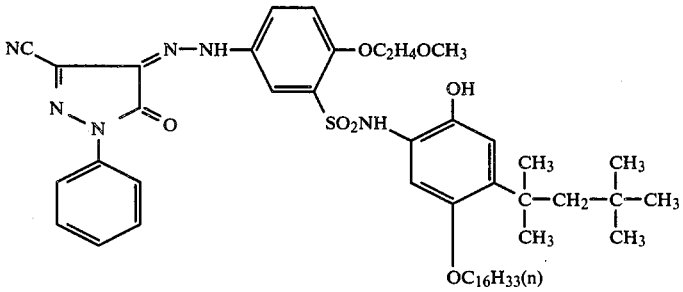

-continued
(III-8)
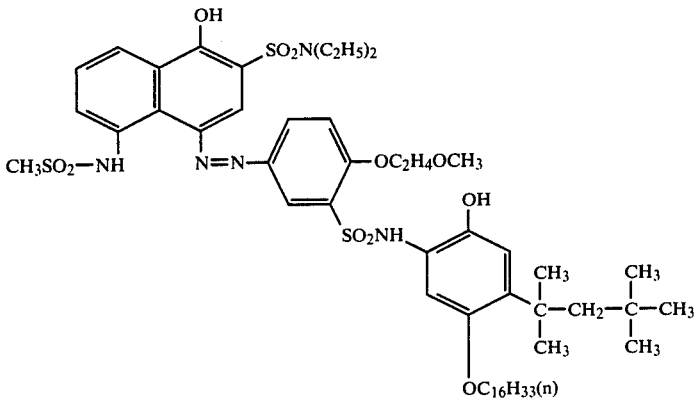
(III-9)
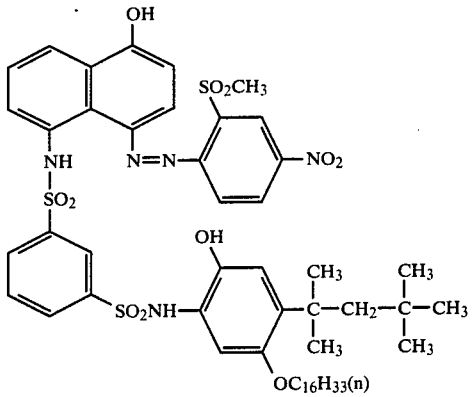
(III-10)
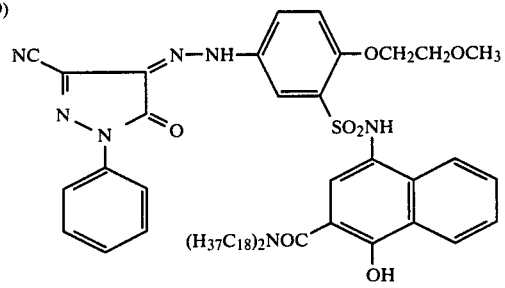
(III-11)
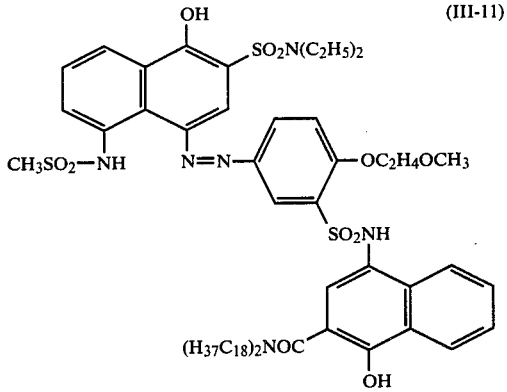
(III-12)
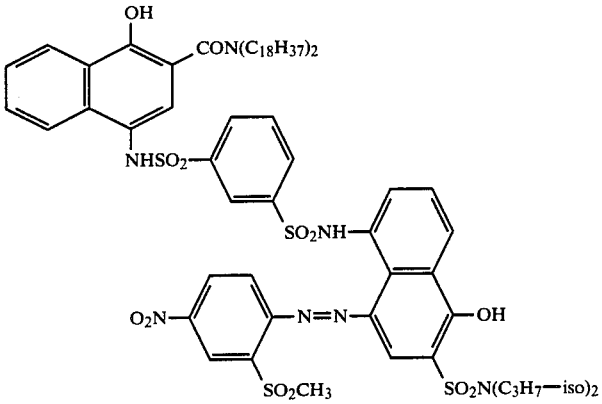
(III-13)
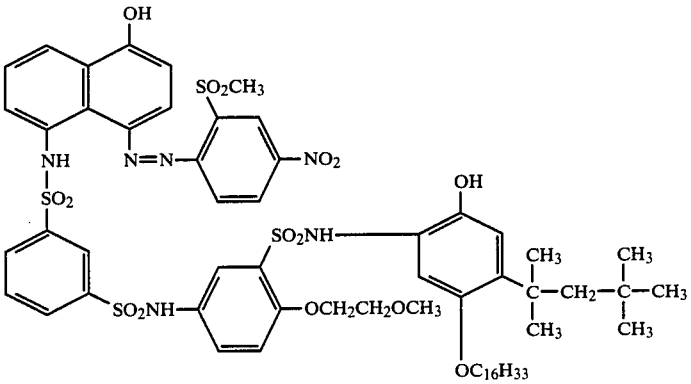

-continued (III-14)

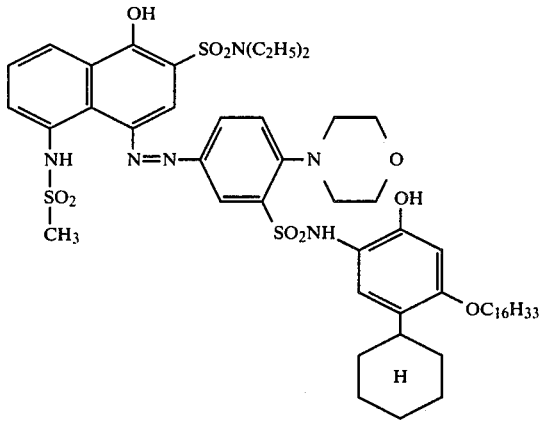

(III-15)

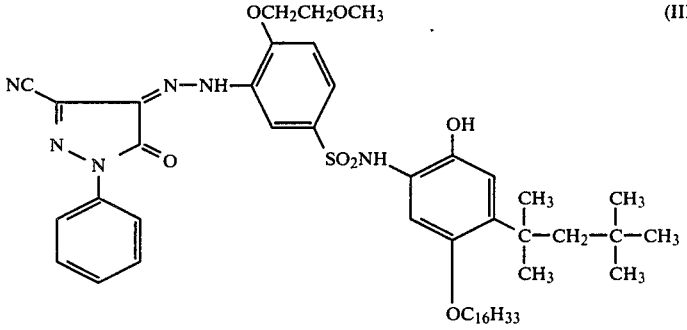

(III-16)

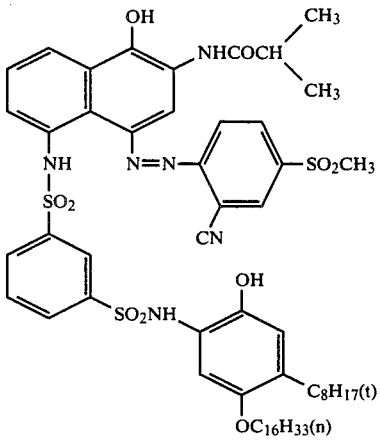

The above described compounds are only certain examples falling within the scope of formula (III), which are not to be construed as limiting the present invention in any manner.

In the method of the present invention, the compound of the formula (I) and the dye providing substance as described above may be incorporated into layer(s) of a light-sensitive material or a dye-fixing material in a known manner, for example, according to a method described in U.S. Pat. No. 2,322,027. In this case, an organic solvent having a high boiling point or an organic solvent having a low boiling point, as described hereinafter, may be used.

For instance, the compound or substance is first dissolved in a high boiling point organic solvent such as an alkyl phthalate (e.g., dibutyl phthalate or dioctyl phthalate), a phosphate (e.g., diphenyl phosphate, triphenyl phosphate, tricresyl phosphate or dioctylbutyl phosphate), a citrate (e.g., tributyl acetyl citrate), a benzoate (e.g., octyl benzoate), an alkylamide (e.g., diethyllaurylamide), a fatty acid ester (e.g., dibutoxyethyl succinate, dioctyl azelate) or a trimesate (e.g., tributyl trimesate); or in a low boiling point organic solvent having a boiling point of about 30° C. to 160° C., such as a lower alkyl acetate (e.g., ethyl acetate or butyl acetate) or ethyl propionate, sec-butyl alcohol, methyl isobutyl ketone, β-ethoxyethyl acetate, methyl cellosolve acetate or cyclohexanone; and the resulting solution is dispersed in a hydrophilic colloid. A mixture of high boiling point organic solvent and low boiling point organic solvent may be used.

In addition, a dispersion method using a polymer as described in Japanese Patent Publication No. 39853/76 and Japanese Patent Application (OPI) No. 59943/76 may also be used for the incorporation of the compound or substance in a light-sensitive material. When a dye providing substance is dispersed in a hydrophilic colloid, various surfactants may be used, and examples of such surfactants are described hereinafter in the present specification.

The amount of the high boiling point organic solvent to be used in the present invention is about 10 g or less, preferably about 5 g or less, per gram of the dye providing substances used.

It is preferred to incorporate a reducing substance in the light-sensitive material used in the present invention, including a conventional reducing agent and the above described reducible dye providing substance. In addition, a reducing agent precursor may also be used as this reducing substance, which itself does not have any reducibility but may become reducible when reacted with a nucleophilic reagent or heated during development.

Examples of reducing agents which may be used in the present invention include inorganic reducing agents such as sodium sulfite or sodium hydrogensulfite; and benzenesulfinic acids, hydrxylamines, hydrazines, hydrazides, borane-amine complexes, hydroquinones, aminophenols, catechols, p-phenylenediamines, 3-pyrazolidinones, hydroxytetronic acid, ascorbic acid and 4-amino-5-pyrazolones. In addition, other reducing agents as described in T. H. James, *The Theory of the Photographic Process*, pp. 291–334 (4th Ed., 1977) may also be used in the present invention. Furthermore, reducing agent precursors as described in Japanese Patent Application (OPI) Nos. 138736/81 and 40245/82 and U.S. Pat. No. 4,330,617 may also be used.

Combinations of various developers as illustrated in U.S. Pat. No. 3,039,869 may also be used in the present invention.

The amount of the reducing agent to be incorporated in a light-sensitive material used in the present invention is about 0.01 to 20 mols, preferably about 0.1 to 10 mols, per mol of the silver used.

In the present invention, an image forming accelerator may be used. Image forming accelerators have various functions, for example, to accelerate the oxidation reduction reaction of a silver salt oxidizing agent and a reducing agent, to accelerate the formation of a dye from a dye providing substance or the decomposition of the dye formed or the release of a diffusible dye from a dye releasing substance, or to accelerate the transfer of the dye formed from a light-sensitive element layer to a dye fixing element layer. According to the physicochemical functions of such accelerators, these may be classified as bases or base precursors, nucleophilic compounds, oils, thermal solvents, surfactants and compounds having a mutual reactivity with silver or silver ions. In this connection, it is to be noted that accelerator substances generally have composite functions and have two or more of the accelerating functions mentioned above.

While image forming accelerators are generally classified herein by function into the following groups, and examples of these groups are illustrated below, the following classification is not critical, and in practice, many compounds have more than one function in the photographic process.

(a) Bases:

Examples of preferred bases are inorganic bases such as alkali metal or alkaline earth metal hydroxides, secondary or tertiary phosphates, borates, carbonates, quinolinates, metaborates; ammonium hydroxides; quaternary alkylammonium hydroxides; and other metal hydroxides; and organic bases such as aliphatic amines (e.g., trialkylamines, hydroxylamines, aliphatic polyamines); aromatic amines (e.g., N-alkyl-substituted aromatic amines, N-hydroxyalkyl-substituted aromatic amines and bis[p-(dialkylamino)phenyl]methanes); heterocyclic amines, amidines, cyclic amidines, guanidines and cyclic guanidines. Those having a pKa of about 8 or more are especially preferred.

(b) Base Precursors:

As base precursors, those capable of releasing a base by a reaction under heat are preferably used, including a salt of an organic acid and a base capable of decarboxylating and decomposing under heat or a compound capable of decomposing and releasing an amine due to intramolecular nucleophilic substitution reaction, Lossen rearrangement, Beckmann rearrangement or the like reaction. Examples of preferred base precursors are salts of trichloroacetic acid, as described in British Pat. No. 998,949; salts of $\alpha$-sulfonylacetic acid as described in U.S. Pat. No. 4,060,420; salts of propiolic acids as described in Japanese Patent Application (OPI) No. 180537/84; 2-carboxycarboxamide derivatives as described in U.S. Pat. No. 4,088,496; salts of pyrolytic acids, in which an alkali metal or alkaline earth metal component is used besides an organic base, as a base component, as described in Japanese Patent Application No. 69597/83; hydroxamecarbamates as described in Japanese Patent Application (OPI) No. 168440/84 undergoing Lossen rearrangement; and aldoximecarbamates capable of forming a nitrile under heat, as described in Japanese Patent Application (OPI) No. 157637/84. In addition, other base precursors as described in British Pat. No. 998,945, U.S. Pat. No. 3,220,846, Japanese Patent Application (OPI) No. 22625/75 and British Pat. No. 2,079,480 are useful.

(c) Nucleophilic Compounds:

Water and water releasing compounds, amines, amidines, guanidines, hydroxylamines, hydrazines, hydrazides, oximes, hydroxamic acids, sulfonamides, active methylene compounds, alcohols and thiols, and salts and precursors of these compounds may be used.

(d) Oils:

High boiling point organic solvents ("plasticizers") which are used for emulsification and dispersion of hydrophobic compounds may be used in the present invention.

(e) Thermal Solvents:

Thermal solvents are those which are solid at room temperature but which melt at approximate development temperature to act as a solvent, including ureas, urethanes, amides, pyridines, sulfonamides, sulfones, sulfoxides, esters, ketones, ethers or the like compounds, which are solid at about 40° C. or lower.

(f) Surfactants:

Pyridinium salts, ammonium salts, phosphonium salts as described in Japanese Patent Application (OPI) No. 74547/84; and polyalkylene oxides as described in Japanese Patent Application (OPI) No. 57231/84 may be used.

(g) Compounds Having Mutual Reactivity with Silver or Silver Ions:

Such compounds include imides; nitrogen-containing heterocyclic compounds as described in Japanese Patent Application (OPI) No. 177550/84; and thiols, thioureas and thioethers as described in Japanese Patent Application (OPI) No. 111636/84.

The image forming accelerators may be incorporated in either of a light-sensitive material or a dye fixing material in the method of the present invention or may be incorporated in both materials. The accelerator may be incorporated in any of an emulsion layer, an intermediate layer, a protective layer, a dye fixing layer or the adjacent layers thereof. Another type of light-sensitive material having both a light-sensitive layer and a dye fixing layer on one support may similarly contain the accelerator in any of the above mentioned layers.

The image forming accelerators may be used singly, or alternatively, several accelerators may be used together, and in general, the latter case where a mixture of image forming accelerators is used is preferred, resulting in achievement of a larger image forming acceleration effect.

In particular, the combination use of a base or base precursor and another accelerator is preferred, as as extremely remarkable image forming acceleration effect may be attained.

In the method of the present invention, other compounds may further be used for the purpose of activation of the development of the light-sensitive material and the stabilization of the image formed. Examples of especially preferred compounds for these purposes are isothiuroniums such as 2-hydroxyethylisothiuronium trichloroacetate, as described in U.S. Pat. No. 3,301,678; bisisothiuroniums such as 1,8-(3,6-dioxaoctane)bis-(isothiuronium trichloroacetate) as described in U.S. Pat. No. 3,669,670; thiol compounds as described in West German Pat. No. 2,162,714; thiazolium compounds such as 2-amino-2-thiazolium trichloroacetate, 2-amino-5-bromoethyl-2-thiazolium trichloroacetate as described in U.S. Pat. No. 4,012,260; bis(2-amino-2-thiazolium)-methylenebis(sulfonylacetate), 2-amino-2-thiazolium phenylsulfonylacetate and 2-amino-2-thiazolium 2-carboxycarboxyamide as described in U.S. Pat. No. 4,060,420.

In addition, other compounds may preferably be used in the present invention, for example, azolethioethers and blocked azolylthione compounds as described in Belgian Pat. No. 768,071; 4-aryl-1-carbamyl-2-tetrazolyl-5-thione compounds as described in U.S. Pat. No. 3,893,859; and compounds as described in U.S. Pat. Nos. 3,839,041, 3,844,788 and 3,877,940.

The light-sensitive material used in the method of the present invention may contain a binder in the form of a single binder or in the form of a mixture of two or more binders, and a hydrophilic binder may be used therefor. In particular, transparent or semi-transparent hydrophilic binders are typical, for example, including natural substances such as proteins, e.g., gelatin, gelatin derivatives or cellulose derivatives, and polysaccharides such as starch or gum arabic; and synthetic polymer substances such as water-soluble polyvinyl compounds, e.g., polyvinylpyrrolidone or acrylamide polymer. In addition, other synthetic polymer substances may also be used as a binder, such as a dispersive vinyl compound in the form of a latex, which may especially increase the dimensional stability of the photographic material.

The amount of the binder to be coated is about 20 $g/m^2$ or less, preferably about 10 $g/m^2$ or less, more preferably about 7 $g/m^2$ or less.

The ratio of high boiling point organic solvent dispersed in the binder together with a hydrophobic compound such as a dye providing substance, to the binder is suitably about 1 cc or less (of the solvent) to 1 g (of binder), preferably about 0.5 cc or less (of the solvent), more preferably about 0.3 cc or less (of the solvent), to 1 g (of the binder).

The photographic light-sensitive material and the dye fixing material used in the method of the present invention may contain an inorganic or organic hardener in the photographic emulsion layer(s) and/or other binder layer(s) of the materials. Examples of hardeners which may be used in the present invention include chromium salts (such as chromium alum and chromium acetate), aldehydes (such as formaldehyde, glyoxal and glutaraldehyde), N-methylol compounds (such as dimethylolurea and methyloldimethylhydantoin), dioxane derivatives (such as 2,3-dihydroxydioxane), active vinyl compounds (such as 1,3,5-triacryloyl-hexahydro-s-triazine, 1,3-vinylsulfonyl-2-propanol and 1,2-bis(vinylsulfonylacetamido)ethane), active halogeno compounds (such as 2,4-dichloro-6-hydroxy-s-trazine), mucohalogenic acids (such as mucochloric acid and mucophenoxychloric acid). These may be used singly or in a mixture of two or more.

The photographic light-sensitive material and a dye fixing material used in the method of the present invention, the latter material being optional, are coated on any conventionally used support material able to resist the treatment temperature. In general, a glass, a paper, a metal or similar materials may be used for the support, and in addition, acetyl cellulose film, cellulose ester film, polyvinyl acetal film, polystyrene film, polycarbonate film, polyethylene terephthalate film or related films or resin materials may be used for the support. Moreover, a laminated paper support formed by lamination of a polymer such as polyethylene on paper may also be used. Polyesters as described in U.S. Pat. Nos. 3,634,089 and 3,725,070 are preferably used in the present invention.

When a dye providing substance capable of imagewise releasing a diffusible dye is used in the present invention, a dye transfer assistant may be used for the purpose of efficient transfer of the dye formed from a light-sensitive layer to a dye fixing layer.

The dye transfer assistant suitably used in a process wherein it is supplied from the outside includes water or an inorganic basic aqueous solution containing an alkali metal salt such as sodium or potassium hydroxide. In addition, a low boiling point solvent such as methanol, N,N-dimethylformamide, acetone, diisobutyl ketone or the like, or a mixed solvent comprising a low boiling point solvent and water or a basic aqueous solution may also be used. In order to apply a dye transfer assistant, the image receiving layer may be wetted with the assistant.

When the dye transfer assistant is incorporated in the light-sensitive material and/or dye fixing material, it is, of course, unnecessary to supply any further dye transfer assistant to the material from the outside. The dye transfer assistant may be incorporated in the materials in the form of water of crystallization or microcapsules, or alternatively, may be incorporated therein in the form of a precursor capable of releasing a necessary solvent at a high temperature. It is especially preferred to incorporate a hydrophilic thermal solvent, which is solid at normal temperature but melts at a high temperature, in the light-sensitive material or in the dye fixing material. Such a hydrophilic thermal solvent may be incorporated in either of the light-sensitive material or the dye fixing material, or may be incorporated in both materials. When a hydrophilic thermal solvent is incorporated in the material(s), it may be incorporated in any of an emulsion layer, intermediate layer, protective layer and dye fixing layer, and in particular, the solvent is preferably incorporated in the dye fixing layer and/or the adjacent layer(s) thereto.

Examples of suitable hydrophilic thermal solvents include ureas, pyridines, amides, sulfonamides, imides, alcohols, oximes and other heterocyclic compounds.

A filter dye or an absorptive substance, as described in Japanese Patent Publication No. 3692/73 and U.S. Pat. Nos. 3,253,921, 2,527,583 and 2,956,879, may be incorporated in the light-sensitive material used in the present invention, particularly for the purpose of improving the sharpness of the image formed. Dyes which may be used for this purpose are preferably dyes capable of being discolored by heat, and preferred dyes are described in U.S. Pat. Nos. 3,769,019, 3,754,009 and 3,615,432.

The light-sensitive materials to be used in the present invention may optionally contain various additives which are known in the field of heat developable light-sensitive materials. They may optionally have other layers than the light-sensitive layer, such as an antistatic layer, an electroconductive layer, a protective layer, an intermediate layer, an antihalation layer, and a peeling layer. Examples of additives which may be included in the various layers of the light-sensitive materials of the present invention are described in *Research Disclosure*, Vol. 170 (June, 1978), No. 17029, and include, for example, a plasticizer, a sharpness improving dye, an antihalation dye, a sensitizing dye, a matting agent, a surfactant, a fluorescent whitening agent, a fading prevention agent or similar conventional additives.

The photographic element used in the method of the present invention comprises a light-sensitive element capable of forming or releasing a dye by heat development and optionally a dye fixing element capable of fixing the formed or released dye. In particular, both a light-sensitive element and dye fixing element are essential in a photographic system where an image is formed by diffusion transfer of a dye. The light-sensitive element and dye fixing element can be separately coated on different two supports, or in another embodiment the photographic material has both the light-sensitive element and the fye fixing element coated on one support.

When the light-sensitive element and the dye fixing element are separately coated on different supports, the photographic material is classified either as a peeling type material or a non-peeling type material. In the former peeling type material, the light-sensitive element-coated surface and the dye fixing element-coated surface are adhered to each other, after imagewise exposure or heat development, and the light-sensitive element is peeled off from the dye fixing element immediately after the image formed has been transferred to the latter dye fixing element. Either a transparent support or an opaque support may appropriately be selected for the support of the dye fixing element, depending upon whether the final image is a reflective type or a transmissive type. If necessary, a white reflective layer may be provided on the light-sensitive material. In the latter non-peeling type material, it is necessary to interpose a white reflective layer between the light-sensitive layer in the light-sensitive element and the dye fixing layer in the dye fixing element, and this white reflective layer may be coated on either the light-sensitive element or the dye fixing element. In addition, it is also necessary that the support of the dye fixing element must be a transparent support.

One typical embodiment in which a light-sensitive element and a dye fixing element are coated on one support, is a non-peeling type in which it is not necessary for the light-sensitive element to be peeled off from the image receiving element, after a transferred image has been formed. In this case, a light-sensitive layer, a dye fixing layer and a white reflective layer are laminated on a transparent or opaque support. Preferred layer embodiments of this type are, for example, transparent or opaque support/light-sensitive layer/white reflective layer/dye fixing layer; or transparent support/dye fixing layer/white reflective layer/light-sensitive layer.

Another typical embodiment where a light-sensitive element and a dye fixing element are coated on one support is described in Japanese Patent Application (OPI) No. 67840/81, Canadian Pat. No. 674,082 and U.S. Pat. No. 3,730,718, in which a part or all of a light-sensitive element is peeled off from a dye fixing element and a peeling layer is provided in the light-sensitive material.

The light-sensitive element or dye fixing element may contain an electroconductive heating element as a heating means for heat development or diffusion transfer of a dye.

The light-sensitive element to be used in the present invention must necessarily have at least three silver halide emulsion layers each having a different sensitivity to a different spectral range, for the purpose of obtaining a colored image of a broad range in a chromaticity diagram, typically using the three primary colors of yellow, magenta and cyan.

Typical combinations of three light-sensitive silver halide emulsion layers each having a different sensitivity to a different spectral range are the combination of a blue-sensitive emulsion layer, a green-sensitive emulsion layer and a red-sensitive emulsion layer; the combination of a green-sensitive emulsion layer, a red-sensitive emulsion layer and an infrared-sensitive emulsion layer; the combination of a blue-sensitive emulsion layer, a green-sensitive emulsion layer and an infrared-sensitive emulsion layer; and the combination of a blue-sensitive emulsion layer, a red-sensitive emulsion layer and an infrared-sensitive emulsion layer. An infrared-sensitive emulsion layer is an emulsion layer having a sensitivity to a light of about 700 nm or more, and especially about 740 nm or more.

The light-sensitive material of the present invention may have two or more emulsion layers having a light sensitivity in the same spectral range, if necessary, separated according to the sensitivity degree of the emulsions.

It is necessary that each of the above described light-sensitive emulsion layers and/or the adjacent light-insensitive hydrophilic colloid layers contain one substance selected from a dye providing substance capable of releasing or forming a yellow hydrophilic dye, a dye providing substance capable of releasing or forming a magenta hydrophilic dye and a dye providing substance capable of releasing or forming a cyan hydrophilic dye. In other words, it is necessary that each of the light-sensitive silver halide emulsion layers and/or the adjacent light-insensitive hydrophilic colloid layers must have a different dye providing substance which releases or forms a different hydrophilic dye having a different hue. If necessary, two or more dye providing substances having the same hue may be used together in the same layer. In particular, when a dye providing substance to be used is previously colored, it is advantageous to provide a separate layer containing the colored dye providing substance apart from the above described emulsion layers. The light-sensitive material to be used in the method of the present invention may further have, in addition to the above described layers, auxiliary layers such as a protective layer, an intermediate layer, an antistatic layer, a curl preventive layer, a peeling layer or a matting layer.

In particular, an organic or inorganic matting agent is generally incorporated in the protective layer (PC) for anti-adhesion. In addition, this protective layer may further contain a mordant agent or a UV absorbent. The protective layer and intermediate layer may comprise two or more layers.

The intermediate layer may contain a reducing agent, a UV absorvent or a white pigment such as $TiO_2$, for the purpose of prevention of color stain. A white pigment may be incorporated not only in the intermediate layer but also in any other emulsion layer(s) for the purpose of increasing the sensitivity of the light-sensitive material.

In order to impart the necessary color sensitivity to the silver halide emulsions as mentioned above, each silver halide emulsion is spectrally sensitized with a conventional sensitizing dye so as to impart the desired spectral sensitivity to each emulsion.

The dye fixing element to be used in the method of the present invention has at least one dye fixing layer containing a mordant agent, and when a dye fixing layer is positioned in the surface of the element, a protective layer may optionally be provided thereon, if necessary.

In addition, a dye transfer assistant may optionally be incorporated in the dye fixing element, or otherwise, a water absorptive layer or a dye transfer assistant-containing layer may optionally be provided in the dye fixing element for the purpose of appropriately regulating the dye transfer assistant contained therein. These layers may be adjacent to the dye fixing layer or may be separated by an intermediate layer.

The dye fixing element to be used in the present invention may optionally have two or more dye fixing layers each containing different mordanting agents having different mordanting capacity.

The dye fixing element to be used in the present invention may additionally have, if necessary, other auxiliary layers such as a peeling layer, a matting layer or a curl preventive layer in addition to the above described layers.

One or more of the above described layers may contain a base and/or a base precursor for the purpose of acceleration of dye transfer, a hydrophilic thermal solvent, a fading preventing agent for the purpose of prevention of color stain, a UV absorbent, a dispersive vinyl compound for the purpose of increase of dimensional stability and a fluorescent whitening agent.

The binder used in the above described layers is preferably hydrophilic, and transparent or semitransparent hydrophilic colloids are typically used including proteins such as gelatin and gelatin derivatives; polyvinyl alcohol; cellulose derivatives; polysaccyarides such as starch, gum arabic and natural substances; and synthetic polymer substances such as water-soluble polyvinyl compounds (e.g., dextrin, pullulan, polyvinyl alcohol, polyvinylpyrrolidone, acrylamide polymers). In particular, gelatin and polyvinyl alcohol are preferred.

The dye fixing element used in the present invention may further contain, in addition to the above described layers, a reflective layer containing a white pigment such as titanium oxide, a neutralizing layer or a neutralizing timing layer, in accordance with the object and the use of the light-sensitive material. Such additional layers may be provided not only in the dye fixing element but also in the other light-sensitive element. The structures of such a reflective layer, a neutralizing layer or a neutralizing timing layer are described, for example, in U.S. Pat. Nos. 2,983,606, 3,362,819, 3,362,821 and 3,415,644 and Canadian Pat. No. 928,559.

In addition, the dye fixing element to be used in the present invention preferably contains a dye transfer assistant, that may be incorporated in the above described dye fixing layer or in any other additional layer.

When an electric heating means is utilized in the development step of the present invention, a transparent or opaque heating element is incorporated in the light-sensitive material, and any and every conventional technique may be applied for the provision of the heating element in the light-sensitive material.

For instance, in order to provide a heating element in the light-sensitive material used in the present invention, a thin film made of an inorganic semiconductive material can be incorporated, or alternatively, an organic thin film containing a dispersion of electroconductive fine particles dispersed in a binder can be incorporated. Materials which may be utilized in the semiconductive film include silicon carbide, molybdenum silicate, lanthanum chromate, barium titanate ceramic which is used as a PTC thermistor, tin oxide or zinc oxide. A transparent or opaque thin layer may be made from such materials in a conventional manner. In the organic thin film electroconductive fine particles such as metal fine particles, carbon black or graphite are dispersed in a rubber, synthetic polymer or gelatin, to obtain a heating element having desired temperature characteristics. The heating element may directly be attached to a light-sensitive element, or may be separated by a support or an intermediate layer.

Any dye fixing layer which is generally used in a heat developable color light-sensitive material may be used for the image receiving layer in the present invention, and a conventional mordanting agent may freely be selected therefor. In particular, polymer mordanting agents are preferred in the present invention, including tertiary amino group-containing polymers, nitrogen-containing heterocyclic moiety-containing polymers and quaternary cation-containing polymers thereof.

Polymers containing tertiary amino group-containing vinyl monomer units are described in Japanese Patent Application Nos. 169012/83 and 166135/83; and examples of polymers containing tertiary imidazole group-containing vinyl monomer units are described in Japanese Patent Application Nos. 226497/83 and 232071183 and U.S. Pat. Nos. 4,282,305, 4,115,124 and 3,148,061.

Preferred examples of polymers containing quaternary imidazolium group-containing vinyl monomer units are described in British Pat. Nos. 2,056,101, 2,093,041 and 1,594,961, U.S. Pat. Nos. 4,124,386, 4,115,124, 4,273,853 and 4,450,224, and Japanese Patent Application (OPI) No. 28225/73.

Other preferred examples of polymers containing quaternary ammonium group-containing vinyl monomer units are described in U.S. Pat. Nos. 3,709,690, 3,898,088 and 3,958,995, Japanese Patent Application Nos. 166135/83, 169012/83, 232070/83, 232072/83 and 91620/84.

As a light source to be used for image exposure of the heat developable light-sensitive material for the purpose of recording an image on the material according to the method of the present invention, radiation including visible light may be used. In general, any light source which may be used in a conventional color photographic process may be used for the image exposure of the present invention, for example, a tungsten lamp, a mercury lamp, a halogen lamp such as an iodine lamp, a xenon lamp, laser rays, cathode ray tube (CRT) light source, a fluorescent lamp, light emitting diode (LED) or similar conventional light source may be used.

The heating temperature in the heat development step in the present invention is preferably about 140° C. or higher, especially preferably about 150° C. or higher, within the above described range. The heating temperature in the transfer step is within the range of from room temperature to the heat development temperature and is preferably in a range from about 60° C. to a temperature lower than the heat development temperature by about 10° C. As a heating means in the development and/or transfer steps, a simple hot plate, a hot iron, a hot roller or other heating elements using carbon or titanium white may be used.

The dye transfer assistant (e.g., water) is added to an interspace between the light-sensitive layer of the heat developing light-sensitive material and the dye fixing layer of the dye fixing material so as to accelerate the transfer of the image formed. For example, it is possible to apply such a dye transfer assistant to either the light-sensitive layer or the dye fixing layer or to both of them, and thereafter to adhere the two layers.

Various conventional heating means may be used in the transfer step in the method of the present invention; for example, the light-sensitive material may be heated by passing it through hot plates or by contacting it with hot plates (e.g., as described in Japanese Patent Application (OPI) No. 62635/75); heated by contacting it with hot drums or hot rollers, while rotated (e.g., as described in Japanese Patent Publication No. 10791/68); heated by passing it through hot air (e.g., as described in Japanese Patent Application (OPI) No. 32737/78); heated by passing it through an inert liquid kept at a determined temperature; or heated by leading it along a heat source by the use of rollers, a belt or similar guide means (e.g., as described in Japanese Patent Publication No. 2546/69). The dye fixing material may be heated directly by means of an electroconductive material layer containing graphite, carbon black or a metal substance previously provided thereon, whereby an electric charge is imparted to the electroconductive layer to directly heat the material.

As explained in detail in the above description, the present invention provides a novel image forming method including a heating step, for formation of a stable image with reduced fog and image mottle.

The present invention will be explained in greater detail by reference to the following example, which, however, is not to be construed as limiting the scope of the present invention. Unless otherwise indicated, all parts, percents and ratios are by weight.

EXAMPLE

A silver iodobromide emulsion was prepared as follows:

40 g of gelatin and 26 g of KBr were dissolved in 3,000 ml of water. The solution obtained was stirred at 50° C., while a solution of 34 g of silver nitrate dissolved in 200 ml of water was added to the solution in the course of 10 minutes.

Afterwards, a solution of 3.3 g of KI dissolved in 100 ml of water was added thereto in the course of 2 minutes.

The pH of the thus formed silver iodobromide emulsion was adjusted and precipitated, and excess salts were removed.

Next, the pH of the emulsion was adjusted to 6.0, and thus, 400 g of the desired silver iodobromide emulsion was obtained.

A gelatin dispersion of a dye providing substance (referred to below as an "image forming substance") containing the compound of formula (I) of the present invention was prepared as follows:

5 g of a dye providing substance (described in the following Table), 0.5 g of 2-ethylhexyl succinate/-sodium sulfonate (as a surfactant), 10 g of triisononyl phosphate, and 0.3 g of o-dodecyloxythiophenol and 0.5 g of a compound within the scope of the formula (I) of the present invention described in the following Table were weighed, and 30 ml of ethyl acetate was added to the mixture of thus weighed components and heated and dissolved at about 60° C., to obtain a uniform solution. The resulting solution and 100 g of a 10% aqueous solution of lime-treated gelatin were stirred and blended and then homogenized in a homogenizer for 10 minutes (10,000 rpm) to obtain a dispersion, referred to as a "dye providing substance dispersion" hereunder.

Preparation of Gelatin Dispersion of Dye Providing Substance

| No. | Dye Providing Substance | Compound of Formula (I) |
|---|---|---|
| Y-1 | (III-4) | (2) |
| Y-2 | " | (4) |
| Y-3 | " | (6) |
| Y-4 (comparison) | " | None |
| M-1 | (III-8) | (2) |
| M-2 | " | (4) |
| M-3 | " | (6) |
| M-4 (comparison) | " | None |
| C-1 | (III-16) | (2) |
| C-2 | " | (4) |
| C-3 | " | (6) |
| C-4 (comparison) | " | None |

Using the above Nos. Y-1, M-1 and C-1, Multilayer Color Light-Sensitive Material (A) having layers described in the following Table was prepared.

| | Light-Sensitive Material (A) |
|---|---|
| 6th Layer | Gelatin (coated amount: 1,000 mg/m$^2$), Base precursor*3 (coated amount: 220 mg/m$^2$) |
| 5th Layer (blue-sensitive emulsion layer) | Silver iodobromide (iodine: 10 mol %, coated amount: (silver) 400 mg/m$^2$), Compound*4 (coated amount: 180 mg/m$^2$); Base precursor*3 (coated amount: 520 mg/m$^2$), Compound No. (2) (described above) (coated amount: 40 mg/m$^2$), Yellow Dye Providing Substance (III-4) (coated amount: 400 mg/m$^2$), Gelatin (coated amount: 1,000 mg/m$^2$), High boiling point solvent*1 (coated amount: 800 mg/m$^2$), Surfactant*2 (coated amount: 100 mg/m$^2$), Compound*5 (coated amount: 24 mg/m$^2$) |
| 4th Layer (intermediate layer) | Gelatin (coated amount: 1,200 mg/m$^2$), Base precursor*3 (coated amount: 220 mg/m$^2$) |
| 3rd Layer (green-sensitive emulsion layer) | Silver iodobromide (iodine: 10 mol %, coated amount: (silver) 400 mg/m$^2$), Compound*4 (coated amount: 180 mg/m$^2$), Sensitizing Dye (D-1) (coated amount: $10^{-6}$ mol/m$^2$), |

-continued

| | Light-Sensitive Material (A) |
|---|---|
| | Base precursor*3 (coated amount: 515 mg/m$^2$), Compound No. (2) (described above) (coated amount: 40 mg/m$^2$), Magenta Dye Providing Substance (III-8) (coated amount: 400 mg/m$^2$), Gelatin (coated amount: 1,000 mg/m$^2$), High boiling point solvent*1 (coated amount: 800 mg/m$^2$), Surfactant*2 (coated amount: 100 mg/m$^2$), Compound*5 (coated amount: 24 mg/m$^2$) |
| 2nd Layer (intermediate layer) | Gelatin (coated amount: 1,000 mg/m$^2$), Base precursor*3 (coated amount: 230 mg/m$^2$) |
| 1st Layer (red-sensitive emulsion layer) | Silver iodobromide (iodine: 10 mol %, coated amount: (silver) 400 mg/m$^2$), Compound*4 (coated amount: 180 mg/m$^2$), Sensitizing Dye (D-2) (coated amount: $8 \times 10^{-7}$ mol/m$^2$), Base precursor*3 (coated amount: 515 mg/m$^2$), Compound No. (2) (described above) (coated amount: 30 mg/m$^2$), Cyan Dye Providing Substance (III-16) (coated amount: 300 mg/m$^2$), Gelatin (coated amount: 1,000 mg/m$^2$), High boiling point solvent*1 (coated amount: 600 mg/m$^2$), Surfactant*2 (coated amount: 100 mg/m$^2$), Compound*5 (coated amount: 18 mg/m$^2$) |
| Support | Polyethylene terephthalate |

*1 $(iso\text{-}C_9H_{19}O)_3P{=}O$

*2 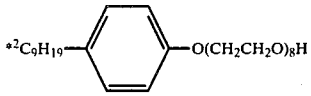

*3 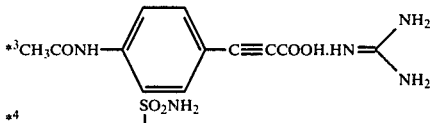

*4 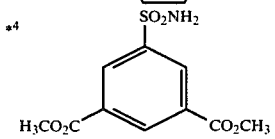

*5 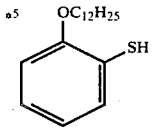

Sensitizing Dye (D-1)

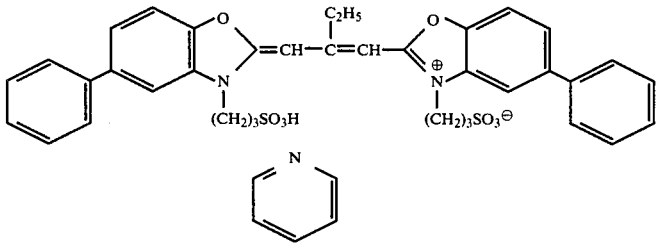

Sensitizing Dye (D-2)

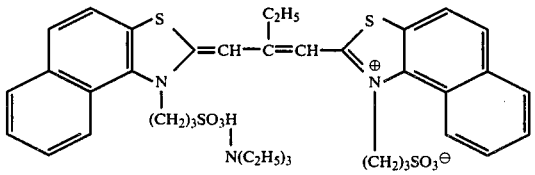

In the same manner as the above Light-Sensitive Material (A), other Light-Sensitive Materials (B), (C) and (D) were produced, with the exception that (B) contained the combination of (Y-2) (M-2) (C-2), (C) contained the combination of (Y-3) (M-3) (C-3) and (D) (comparative sample) contained the combination of (Y-4) (M-4) (C-4), instead of the combination of the gelatin dispersions (Y-1) (M-1) (C-1) in Material (A), in the same amounts of each dispersion of a dye providing substance.

An image receiving material having an image receiving layer was prepared as follows:

Gelatin Hardeners (H-1: 0.75 g and H-2: 0.25 g), 160 ml of water and 100 g of a 10% aqueous lime-treated gelatin solution were uniformly blended, and the resulting solution was uniformly coated on a paper support laminated with a dispersion containing polyethylene and titanium dioxide to form a film having a wet thickness of 60 μm and then dried.

Gelatin Hardener H-1:

$CH_2{=}CHSO_2CH_2CONHCH_2CH_2NHCOCH_2.$
$.SO_2CH{=}CH_2$

Gelatin Hardener H-2:

$CH_2{=}CHSO_2CH_2CONHCH_2.CH_2CH_2NHCOCH-$
$_2SO_2CH{=}CH_2$

Next, 15 g of a polymer having the following structure was dissolved in 200 ml of water and then uniformly blended with 100 g of 10% aqueous lime-treated gelatin solution. The resulting solution was uniformly coated on the above coated film to form a film having a wet thickness of 85 μm. This sample was dried, which was used as a dye fixing material. Polymer (having a limiting viscosity of 0.3473, as measured in a 1/20M $Na_2HPO_4$ aqueous solution at 30° C.):

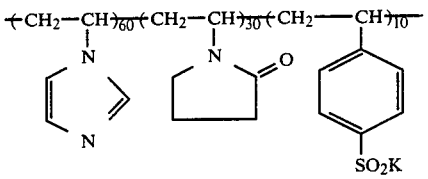

In the next step, each of the above formed Multilayer Color Light-Sensitive Materials (A) through (D) was exposed to a tungsten lamp of 2,000 luxes for 10 seconds, through a B-G-R three color separation filter having a continuously varying color density distribution.

After the exposure, each sample was uniformly heated on a heat block heated at 150° C. for 20 seconds or 30 seconds.

Next, the image receiving material was dipped in water, and then each of the above heated Light-Sensitive Materials (A) through (D) was adhered to the wetted image receiving material, the surfaces of the coated films of the two materials being in face-to-face contact.

The adhered materials were heated on a heat block at 80° C. for 6 seconds, and then the image receiving material was peeled off from the light-sensitive material, whereby negative yellow, magenta and cyan color images were formed on the image receiving material, respectively. The density of the negative images formed was measured using a Macbeth reflection densitometer (RD-519), and the results were as follows:

| Sample | Compound No. | Filter | Density (parenthesized data: minimum density) Heated at 150° C. for 20 Seconds | Heated at 150° C. for 30 Seconds |
|---|---|---|---|---|
| A | (2) | B | 1.92 (0.14) | 1.98 (0.18) |
| | | G | 2.00 (0.18) | 2.09 (0.21) |
| | | R | 2.08 (0.15) | 2.16 (0.17) |

-continued

| Sample | Compound No. | Filter | Density (parenthesized data: minimum density) Heated at 150° C. for 20 Seconds | Heated at 150° C. for 30 Seconds |
|---|---|---|---|---|
| B | (4) | B | 1.90 (0.13) | 1.94 (0.17) |
| | | G | 1.97 (0.15) | 2.01 (0.19) |
| | | R | 2.10 (0.15) | 2.13 (0.20) |
| C | (6) | B | 1.94 (0.19) | 2.00 (0.22) |
| | | G | 2.02 (0.19) | 2.08 (0.24) |
| | | R | 2.13 (0.16) | 2.17 (0.20) |
| D (comparison) | None | B | 1.94 (0.18) | 2.07 (0.31) |
| | | G | 2.04 (0.20) | 2.21 (0.38) |
| | | R | 2.14 (0.17) | 2.28 (0.29) |

The above Table demonstrates that even when the development time was prolonged by 10 seconds, the maximum density and the minimum density in the color image formed increased only slightly in Samples (A) through (C) due to the incorporation of Compound No. (2), (4) or (6) according to the invention. In contrast, the fog in Comparative Sample (D) was greatly increased. It is apparent from these results that the compounds of the general formula (I) according to the invention have a high development stopping effect.

While the invention has been described in detail and with reference to specific embodiments thereof, it will be apparent to one skilled in the art that various changes and modifications can be made therein without departing from the spirit and scope thereof.

What is claimed is:

1. A method for formation of an image which comprises imagewise exposing a heat-developable light-sensitive silver halide material to radiation during or after the imagewise exposure, the heating being carried out in the presence of a compound of general formula (I):

$$X{-}SO_2(DI) \qquad (I)$$

wherein X represents a reducing group capable of reducing a silver salt and capable of being oxidized by heating and in its oxidized state capable of releasing a compound represented by (DI)—$SO_2NH_2$ by reaction with a nucleophilic agent; and (DI) represents a development inhibiting group capable of inhibiting the oxidation reduction reaction of the silver salt and a reducing agent.

2. A method for formation of an image comprising a heating step as claimed in claim 1, wherein said reducing group of X in the formula (I) comprises a ballast group making the compound of formula (I) substantially nondiffusible.

3. A method for formation of an image comprising a heating step as claimed in claim 2, wherein said ballast group is a hydrophobic group having 8 or more carbon atoms selected from the group consisting of an alkyl group, an aralkyl group and an alkoxy group.

4. A method for formation of an image comprising a heating step as claimed in claim 1, wherein said development inhibiting group represented by (DI) is a compound of general formula (II):

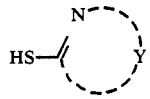

(II)

or a tautomer thereof, wherein Y represents an atomic group necessary for formation of a 5-membered or 6-membered heterocyclic ring containing at least one hetero atom selected from a sulfur atom, a nitrogen atom and an oxygen atom in the ring.

5. A method for formation of an image comprising a heating step as claimed in claim 4, wherein said development inhibiting group of general formula (II) is selected from the group consisting of

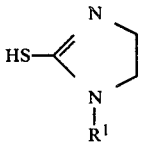

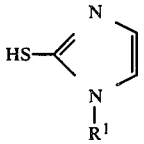

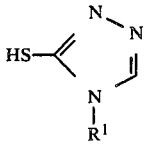

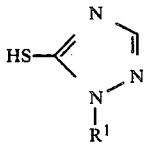

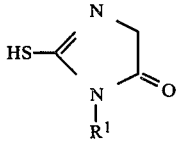

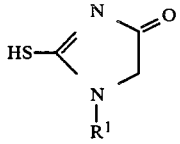

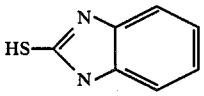

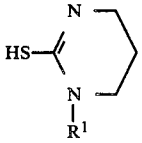

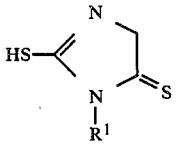

-continued

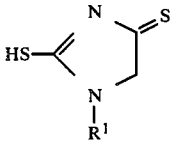

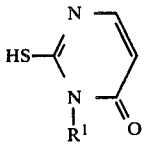

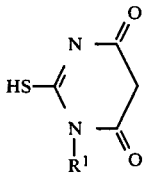

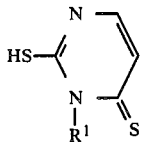

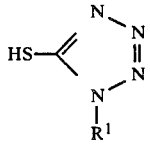

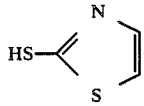

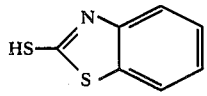

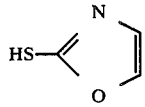

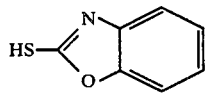

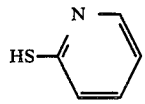

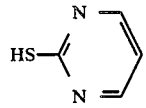

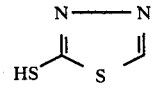

-continued

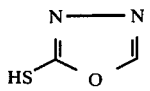

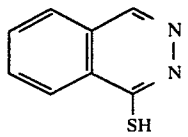

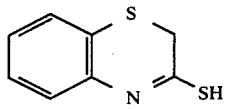

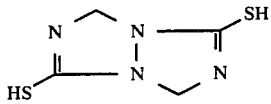

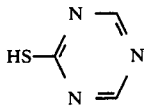

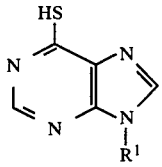

and

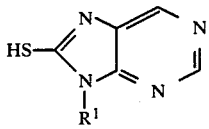

wherein $R^1$ represents a group selected from a hydrogen atom, an alkyl group, an aryl group, an aryl group, a cycloalkyl group, an alkenyl group and an aralkyl group.

6. A method for formation of an image comprising a heating step as claimed in claim 4, wherein the active SH group of the compound of general formula (II) or the active NH group of a tautomer thereof is blocked with a protective group capable of being removed during heat development.

7. A method for formation of an image comprising a heating step as claimed in claim 5, wherein the active SH group of said compound or the active NH group of a tautomer thereof is blocked with a protective group capable of being removed during heat development.

8. A method for formation of an image comprising a heating step as claimed in claim 1, wherein said development inhibiting group represented by (DI) is a compound selected from the group consisting of:

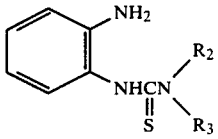

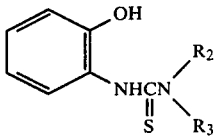

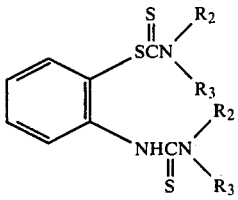

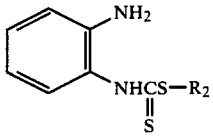

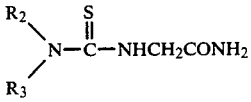

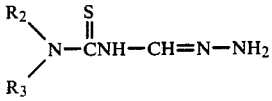

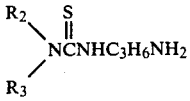

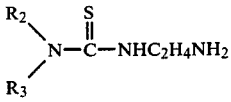

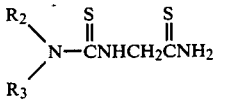

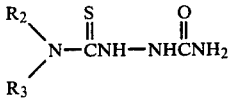

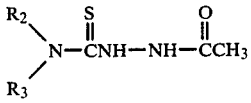

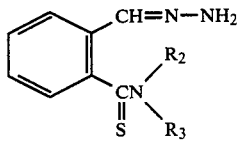

and

-continued
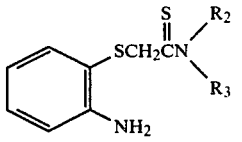
wherein $R_2$ and $R_3$ each represents a substituent selected from a hydrogen atom, an alkyl group, an aralkyl group, a cycloalkyl group, an aryl group and a heterocyclic group.
9. A method for formation of an image comprising a heating step as claimed in claim 1, wherein said compound of the general formula (I) is selected from the group consisting of:
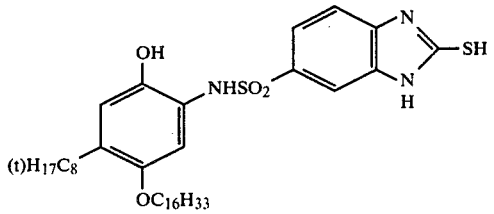
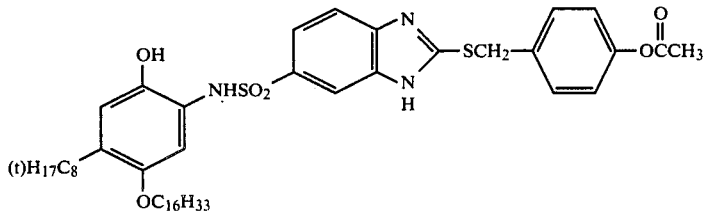
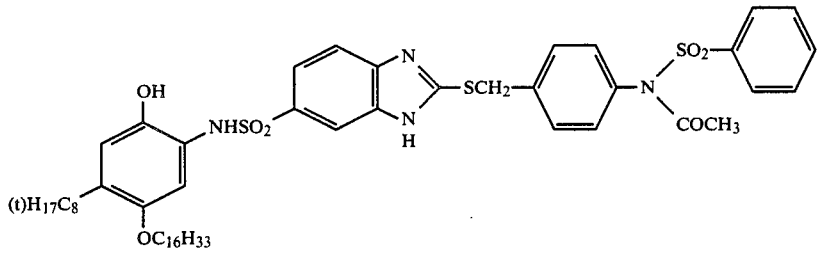
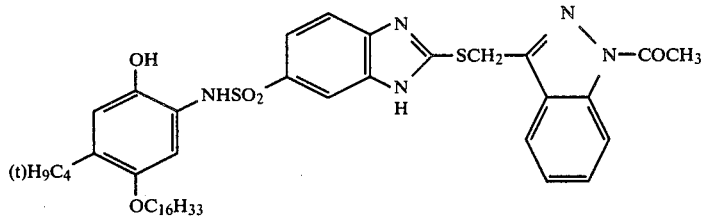
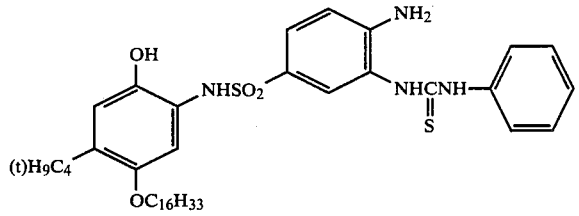
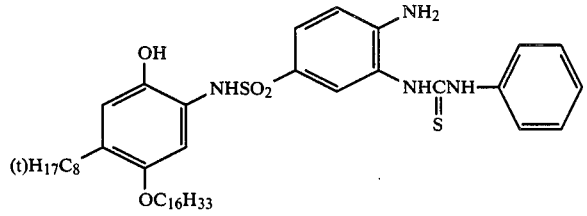

-continued
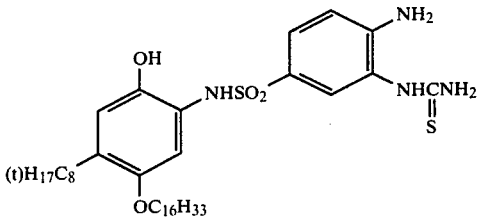
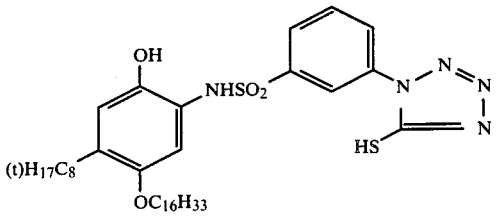
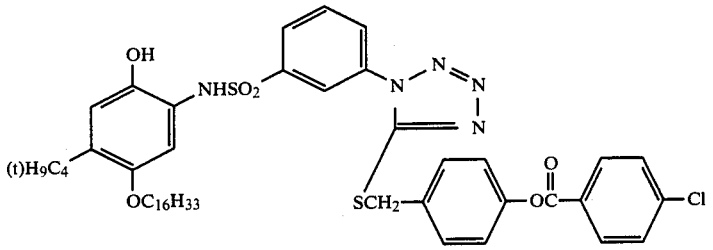
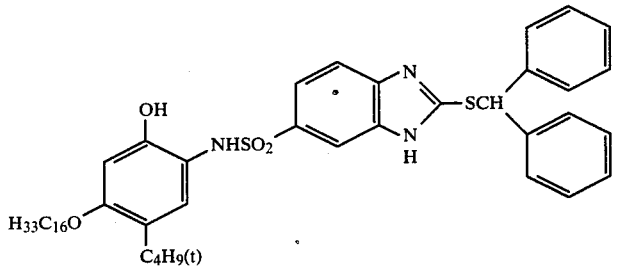
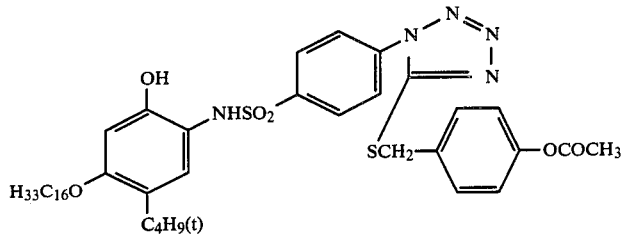
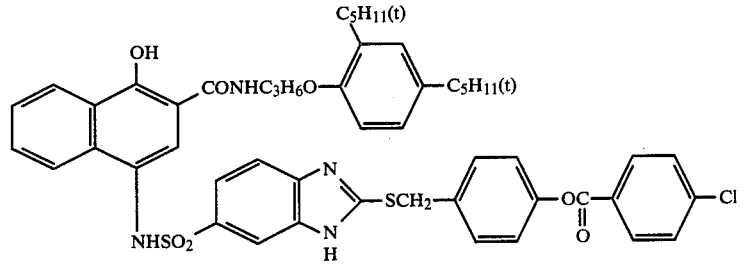

-continued
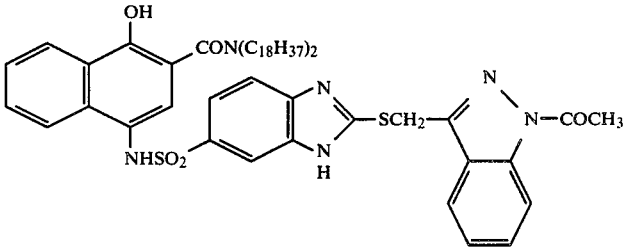
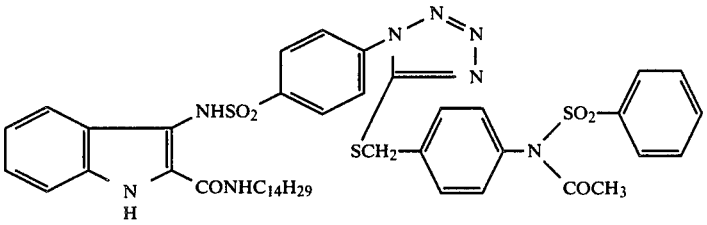
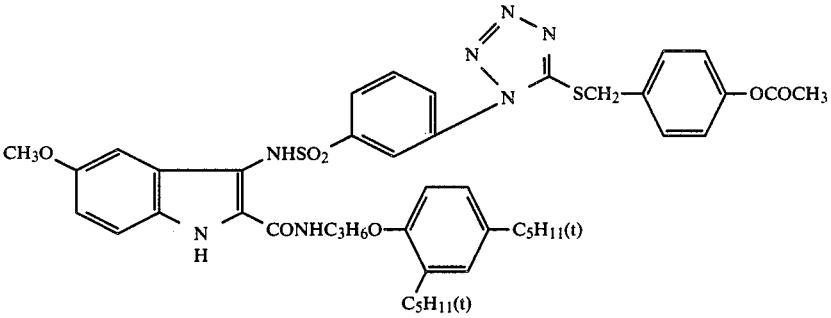
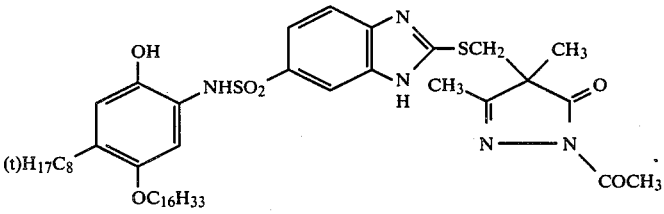
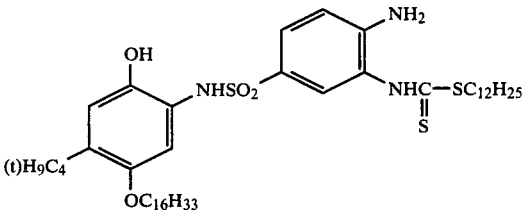
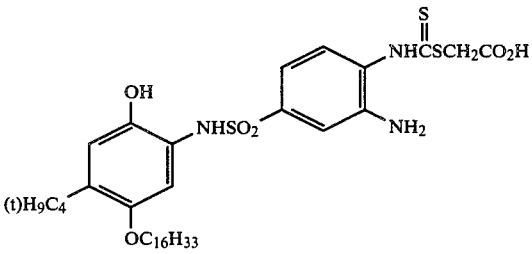

-continued
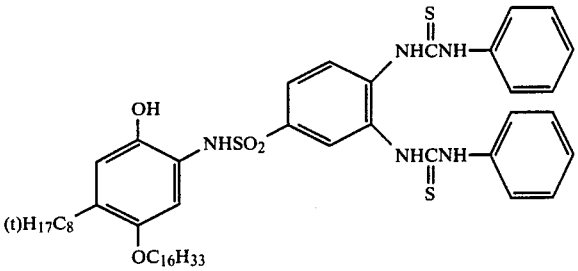
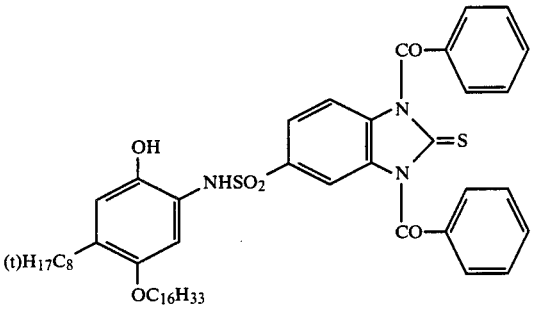
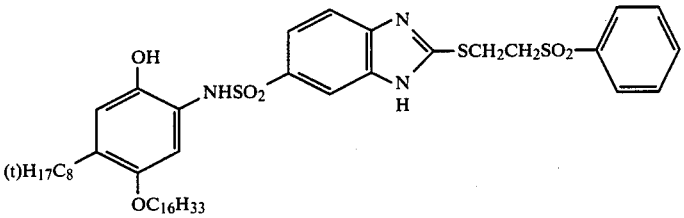
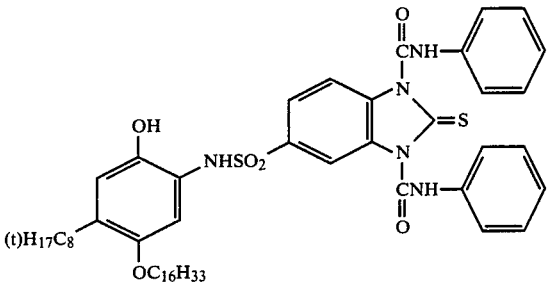
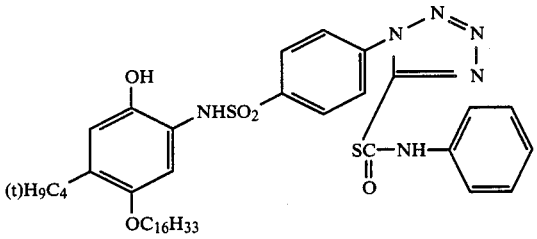
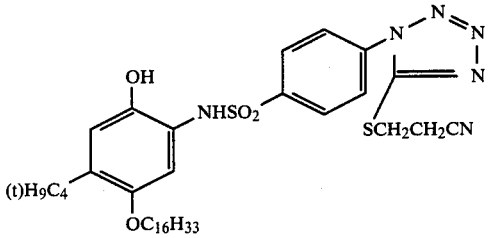

-continued

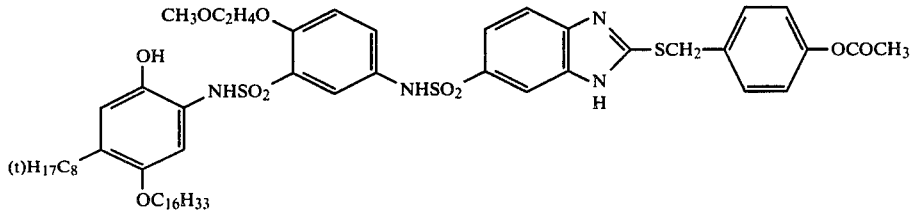

and

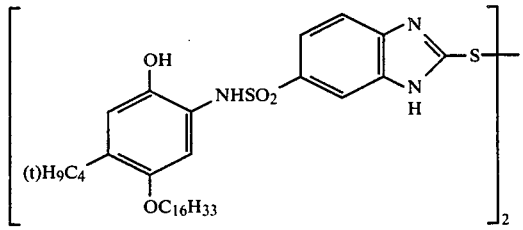

10. A method for formation of an image comprising a heating step as claimed in claim 1, wherein said heating is carried out in the step of heat development, in the step of heat transferring or in the step of imagewise heat exposure, in the presence of the compound of the general formula (I).

11. A method for formation of an image comprising a heating step as claimed in claim 1, wherein said heating is carried out in the step of heat development, in the presence of the compound of the general formula (I).

12. A method for formation of an image comprising a heating step as claimed in claim 11, wherein said compound of the general formula (I) is incorporated in a light-sensitive material.

13. A method for formation of an image comprising a heating step as claimed in claim 1, said silver halide light-sensitive material contains a compound of general formula (III):

$$(\text{Dye—X'})_n\text{—Y'} \qquad \text{(III)}$$

wherein Dye represents a dye residue or a dye precursor residue; X' represents a single bond or a linking group; Y' represents a group capable of yielding a difference of diffusibility of a compound of formula $(\text{Dye—X'})_n\text{—Y'}$, corresponding to or reversely corresponding to a light-sensitive silver salt in imagewise latent image distribution, or alternatively Y' represents a group capable of releasing Dye and yielding a difference of diffusibility between the released Dye and the compound of formula $(\text{Dye—X'})_n\text{Y'}$; and n is an integer of 1 or 2.

* * * * *